US012497204B2

(12) United States Patent
Magnell

(10) Patent No.: US 12,497,204 B2
(45) **Date of Patent: *Dec. 16, 2025**

(54) PATCH TO POUCH SYSTEMS

(71) Applicant: WestRock Shared Services, LLC, Atlanta, GA (US)

(72) Inventor: Greg Magnell, Vicksbury, MI (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/120,829

(22) Filed: Mar. 13, 2023

(65) Prior Publication Data

US 2023/0278740 A1 Sep. 7, 2023

Related U.S. Application Data

(63) Continuation of application No. 17/080,192, filed on Oct. 26, 2020, now Pat. No. 11,603,226.

(60) Provisional application No. 63/077,644, filed on Sep. 13, 2020.

(51) Int. Cl.

| | |
|---|---|
| ***B65B 43/04*** | (2006.01) |
| ***B65B 5/02*** | (2006.01) |
| ***B65B 39/14*** | (2006.01) |
| ***B65B 43/30*** | (2006.01) |
| ***B65B 43/54*** | (2006.01) |
| ***B65B 57/02*** | (2006.01) |
| ***B65B 59/00*** | (2006.01) |

(52) U.S. Cl.

CPC ..... *B65B 43/04* (2013.01); *B65B 5/022* (2013.01); *B65B 39/145* (2013.01); *B65B 43/30* (2013.01); *B65B 57/02* (2013.01); *B65B 59/001* (2019.05); *B65B 59/005* (2013.01); *B65B 43/54* (2013.01)

(58) Field of Classification Search

CPC ..... B65B 43/04; B65B 43/30; B65B 43/305; B65B 43/54; B65B 43/267; B65B 5/022; B65B 7/06; B65B 9/13; B65B 9/14; B65B 51/02; B65B 51/023; B65B 59/005; B65B 59/001; B31B 50/622; B31B 2150/003; B31B 2155/003; B31B 70/62–628

USPC ..... 53/570

See application file for complete search history.

(56) References Cited

U.S. PATENT DOCUMENTS 1,970,193 A * 8/1934 Riebel, Jr. ..... B65B 31/06 53/433
1,983,939 A * 12/1934 Kehr ..... B31B 70/00 156/203
2,179,685 A * 11/1939 Chalmers ..... B65B 19/02 493/252
2,248,255 A * 7/1941 Staude ..... B31B 70/00 118/103
2,261,782 A * 11/1941 Staude ..... B31B 70/626 427/195
2,412,862 A * 12/1946 Bergstein ..... B65B 51/023 53/373.6

(Continued)

*Primary Examiner* — Joshua G Kotis

(74) *Attorney, Agent, or Firm* — Neil G. Cohen; Rohini K. Garg

(57) ABSTRACT

A method includes separating a portion of a flattened tube of stock packing material to a custom length to form a pouch pre-form and closing a first end of the pouch pre-form leaving a second end of the pouch pre-form open. The method can include placing product into the pouch pre-form and closing the one open end of the pouch pre-form to form a closed pouch containing the product.

16 Claims, 40 Drawing Sheets

(56) References Cited

U.S. PATENT DOCUMENTS 2,948,098 A * 8/1960 Hanson ..... B65B 51/023 53/372.6
2,986,079 A 5/1961 Triolo
3,053,150 A * 9/1962 Mossor ..... B31B 70/00 493/929
3,236,021 A 2/1966 Wagner
3,554,099 A * 1/1971 Rodley ..... B31F 1/10 493/224
3,924,521 A * 12/1975 Hanson ..... B31B 70/00 493/239
3,988,970 A 11/1976 Hanson et al.
3,990,354 A * 11/1976 Ward ..... B31B 70/62 493/266
4,089,255 A * 5/1978 Akoh ..... B65B 3/025 493/200
4,170,929 A 10/1979 McDowell
4,248,032 A * 2/1981 Woods ..... B65B 43/30 53/261
4,610,651 A * 9/1986 Jacobson ..... B65D 75/68 493/212
4,864,802 A * 9/1989 D'Angelo ..... B29C 66/0242 156/320
5,271,206 A 12/1993 Tetenborg
5,442,897 A 8/1995 Hinzmann et al.
5,537,806 A 7/1996 Grierson et al.
5,560,185 A 10/1996 Petkovsek
5,618,252 A 4/1997 Melville
6,460,317 B1 10/2002 Voss
6,586,050 B1 * 7/2003 Fort ..... B65B 51/023 427/288
11,345,500 B1 * 5/2022 Kalm ..... B65B 43/30
2003/0049371 A1 * 3/2003 Fort ..... B65B 51/023 427/207.1
2006/0030470 A1 2/2006 Voss et al.
2006/0037711 A1 * 2/2006 Duwendag ..... B05C 1/027 156/578
2006/0283152 A1 * 12/2006 Kawakami ..... B65B 25/18 53/481
2006/0283156 A1 12/2006 Concetti
2007/0289262 A1 * 12/2007 Koehn ..... B65B 43/04 53/452
2011/0053747 A1 * 3/2011 Haeger ..... B31B 70/00 493/210
2011/0230323 A1 * 9/2011 Robinette ..... B31B 70/00 493/243
2011/0263400 A1 * 10/2011 Sargin ..... B65D 33/22 493/227
2013/0239521 A1 9/2013 Cinotti et al.
2015/0049960 A1 * 2/2015 Tan ..... B65D 33/08 425/301
2015/0321781 A1 11/2015 Kristensen et al.
2016/0280409 A1 9/2016 Verma
2017/0203867 A1 * 7/2017 Shook ..... B65B 43/267
2018/0022053 A1 * 1/2018 Köhn ..... B29C 66/53462 156/73.1
2019/0291379 A1 9/2019 Reischer et al.
2020/0369417 A1 11/2020 Pieper et al.

* cited by examiner

PATCH TO POUCH SYSTEMS

CROSS-REFERENCE TO RELATED APPLICATIONS

This application is a continuation of U.S. patent application Ser. No. 17/080,192 filed Oct. 26, 2020, now granted as U.S. Pat. No. 11,603,226 granted Mar. 14, 2023, which claims priority to U.S. Provisional Application Ser. No. 63/077,644 filed Sep. 13, 2020 the contents of each of which are incorporated herein by reference in their entirety.

BACKGROUND OF THE INVENTION

1. Field of the Invention

The present disclosure relates to packaging, and more particularly to packaging for shipping such as in e-commerce.

2. Description of Related Art

Shipping needs for e-commerce and the like include considerable volume of packaging used for shipping products. Multiple items can be grouped in a single order, but in order to economize and ship the products together, they must be packaged together in a single sipping container. In other cases, a single product such as a book may be shipped on its own, but it needs a shipping package or container to protect it during transit.

Fulfilment centers where products are placed in shipping containers match orders with one or more products by size to an appropriate shipping container. Given the large variation in order and products sizes, there must be a large variety of shipping containers in stock. Systems that provide custom-sized shipping packages on an order by order basis can considerably reduce the complications in fulfilment centers.

The conventional techniques have been considered satisfactory for their intended purpose. However, there is an ever present need for improved packaging systems and methods. This disclosure provides a solution for this need.

SUMMARY OF THE INVENTION

A system includes a conveyor and a separator. A controller is operatively connected to the conveyor and to the separator to control the conveyor to drive a custom length of a flattened tube of stock packaging material through the separator, and to control the separator to separate a custom length of the tube from the tube to form a pouch pre-from.

The conveyor can be a first conveyor. A first closer assembly can be operatively connected to the separator to receive the pouch pre-form. A second conveyor can be included, and a filling station can be operatively connected to the first closer assembly and to the second conveyor to receive the pouch pre-form with one end closed from the first closer assembly and to receive orders of product from the second conveyor. A second closer assembly can be operatively connected to the filling station to receive pouch pre-forms with product therein from the filling station.

A sensor system can be operatively connected to controller and to the second conveyor to measure custom orders of product passing through the sensor system on the second conveyor and to control the first conveyor and separator to cut the custom length of the tube to fit each custom order of product. The separator can include a retractable holder mounted for movement relative to the slide to press the tube flat. A rotary knife can be mounted on a mechanism for traversing the flat tube to cut the custom length of the tube.

The first closer can includes a portion of the slide with retractable tines with an extended position for receiving the pouch pre-form from the cutter and to hold the pouch pre-form during erecting and closing one end of the pouch pre-form, and a retracted position for allowing a pre-form with one closed end to pass from the first closer. A closure plate can be included parallel to the slide mounted for movement relative to the slide to press the pouch pre-form flat after erecting the pouch pre-form and applying adhesive to close one end of the pouch pre-form. An opposed pair of lateral plates can extend along the slide on opposite sides of the closure plate mounted for movement relative to the slide to laterally close inward on the pouch-preform to erect the pouch pre-form. An adhesive applicator can be mounted for lateral movement relative to the slide, configured to apply adhesive to one end of the erect pouch pre-form prior to pressing with the closure plate to close a lower end of the pouch pre-form with respect to the direction of gravity.

The filling station can include a pivot shuttle configured to receive the closed end of the pouch pre-form and to flip the open end of the pouch pre-form away from the first closer. A third conveyor can be operatively connected to the filling station to receive partially closed pouches with product therein and to convey the partially closed pouches away from the filling station. The third conveyor can include a labeler.

A system includes a conveyor configured to drive a flattened tube of corrugated paper board and a separator. A controller is operatively connected to the conveyor and to the separator to control the conveyor to drive a length of the flattened tube of corrugated paper board along a slide through the separator and then stop, and to control the separator to separate a length of the tube from the tube to form a pouch pre-from.

A mailer includes a single piece of rigid tube form substrate wrapped around an internal space wherein two parallel, opposed edges of the single piece are adhered to one another to form a tube around the interior space. A first end of the tube is adhered to itself to enclose a first end of the interior space. A second end of the tube opposite the first end of the tube is adhered to itself to enclose a second end of the interior space.

The rigid tube form substrate can include at least one of corrugated paperboard and/or solid fiber cardboard. The two parallel, opposed edges can be adhered together to form a seam in a first panel of the tube along a first side of the interior space. The tube can include two side panels each connected to the first panel along a respective fold line, each side panel extending from the first end of the tube to the second end of the tube, wherein each side panel includes an inward pleat formed by a fold line extending parallel to the seam from the first end of the tube to the second end of the tube. The tube can define an interior surface and an exterior surface, wherein the interior of the surface at the first end of the tube is adhered in face to face position with itself. The first end of the tube can include pleated portions where the interior surface is adhered in face to face position with itself on either side of a main face to face portion of the first end of the tube. The second end of the tube can be adhered in face to face position with itself. The second end of the tube can include pleated portions where the interior surface is adhered in face to face position with itself on either side of a main face to face portion of the second end of the tube.

A method includes separating a portion of a flattened tube of stock packing material to a custom length to form a pouch pre-form and closing a first end of the pouch pre-form leaving a second end of the pouch pre-form open. The method can include placing product into the pouch pre-form and closing the one open end of the pouch pre-form to form a closed pouch containing the product.

The method can include adding shipping indicia to an exterior surface of the pouch. The It is also contemplated that closing the first end of the pouch pre-form can include adhering an interior surface of the tube in face to face contact with itself at a first end of the pouch pre-form. Closing the second end of the pouch pre-form can include adhering an interior surface of the tube in face to face contact with itself at the second end of the pouch pre-form. The method can include matching product size to the pouch pre-form by cutting the tube to a predetermined length based on the product size. It is also contemplated that the method can include repeating cutting, closing a first end, placing product, and closing the one open end for a plurality of orders of product, wherein each order of product has bespoke dimensions, and wherein each pouch is fit to the respective bespoke dimensions.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
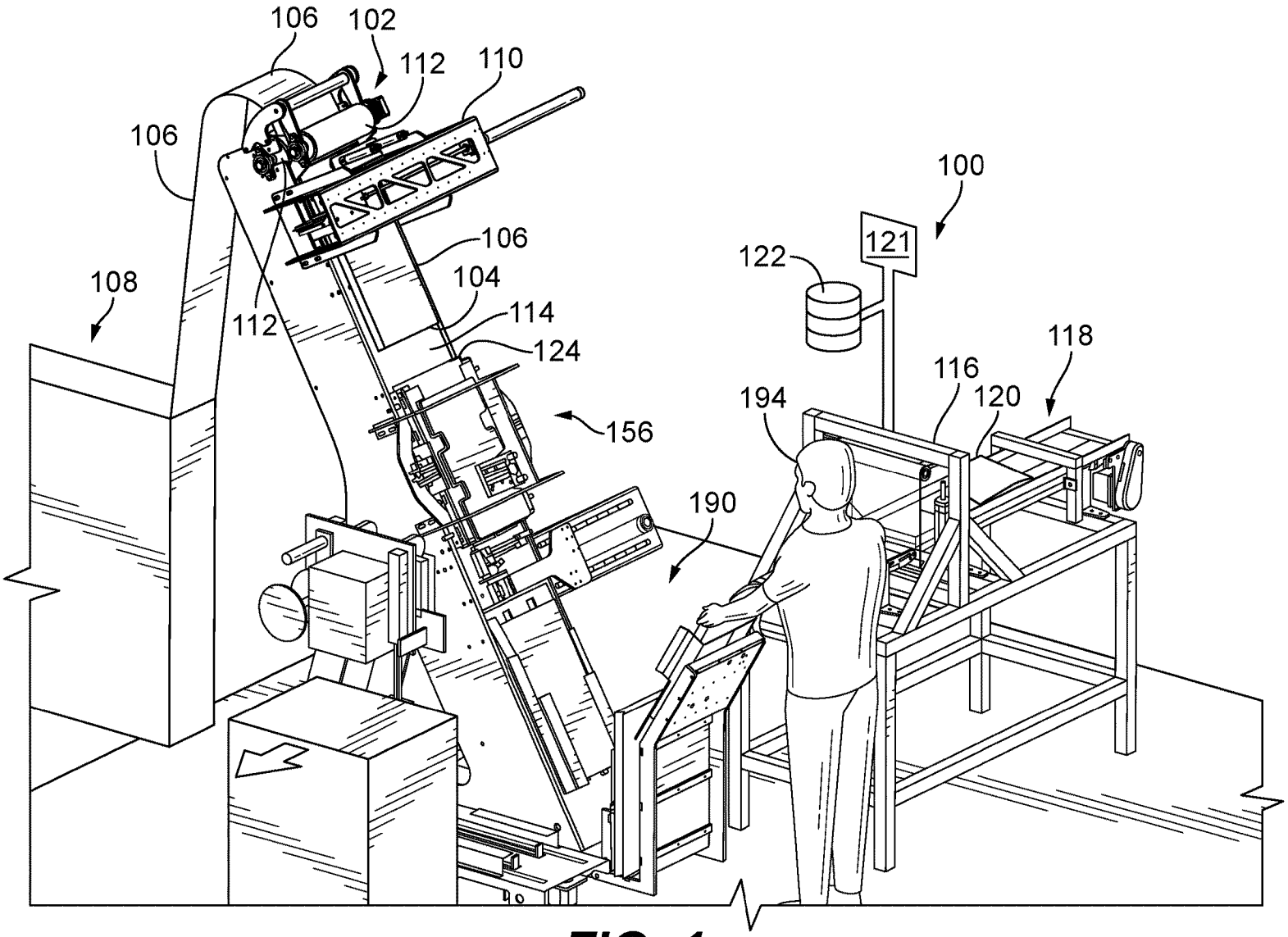
FIG. 1 is a perspective view of an embodiment of a system constructed in accordance with the present disclosure, showing the conveyors and stations for packing orders of product in custom or bespoke mailers.

Reference will now be made to the drawings wherein like reference numerals identify similar structural features or aspects of the subject disclosure. For purposes of explanation and illustration, and not limitation, a partial view of an embodiment of a system in accordance with the disclosure is shown in FIG. 1 and is designated generally by reference character 100. Other embodiments of systems in accordance with the disclosure, or aspects thereof, are provided in FIGS. 2-38, as will be described. The systems and methods described herein can be used to package products within bespoke or custom sized mailers for each order being shipped.

The system 100 includes a first conveyor 102 for conveying an end 104 of a flattened tube 106 of stock packing material from a supply 108 in the form of a fan-folded bale. The first conveyor 102 includes an opposed pair of rollers that roll the tube 106 therebetween to advance the tube 106 down a slide 114. A separator 110 is operatively connected to the first conveyor 102 for receiving the end 106 of the flattened tube 106. The first conveyor 102 is configured to feed a custom length of the tube 106 into the separator 110. A an x-y array sensor system 116 is operatively connected to a second conveyor 118 to measure custom orders of product 120 passing through the sensor system 116 on the second conveyor 118, provide measurement input to a controller 121 that is connected to control the first conveyor 102 and separator 110 to separate the custom length of the tube 106 to fit each custom order of product 120. Those skilled in the art will readily appreciate that the any suitable sensor system can be used in addition to or in lieu of sensor system 116, e.g. an imaging device with an imaging processing module for determining the size of product 120 passing through the field of view, can be placed further upstream than depicted in FIG. 1 without departing from the scope of this disclosure. It is also contemplated that in addition to or in lieu of the sensor system 116, any other suitable type of sensor system can be used, such as devices that measure by physical contact, or that known dimensions for products traveling in order on the second conveyor 118 can be provided from a database 122 operatively connected to control the first conveyor 102 and separator 110 without making measurements.

Figure 2:
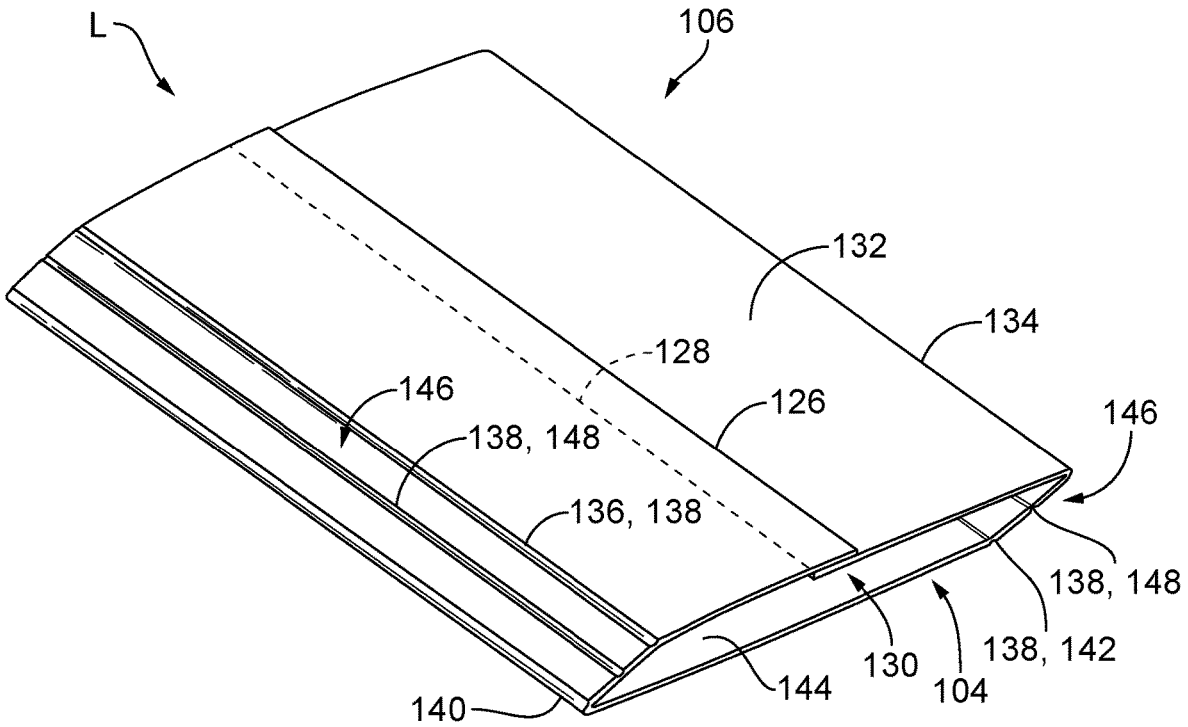
FIG. 2 is a perspective view of an embodiment of a flattened tube of stock packing material for the system of FIG. 1, showing the lines of weakness for the pleats.

The separator 110 is configured to separate the custom length of the tube 106 from the tube 106 for each respective product 120 arriving on the second conveyor 118 to form a custom sized pouch pre-form 124 that can differ for each individual pouch pre-form 124. FIG. 2 shows the end 104 of the tube 106. The two parallel, opposed edges 126, 128 are overlapped and adhered together to form a seam 130 in a first panel 132 of the tube running along the tube 106 in a longitudinal direction L. In its flat state as it arrives at the conveyor 106 from the supply 108, as shown in FIG. 2, the tube 106 includes lines of weakness 138, e.g., score lines, for forming two opposed, pleated side panels 146 each connected to the first panel 132 along a respective fold line 134, 136. A seamless second panel 144 opposite the first panel 132 is connected to the side panels 146 by fold line 140 and a line of weakness 138 for forming a fold line 142. The pleat lines 148 are formed by the remaining lines of weakness 138.

Figure 3:
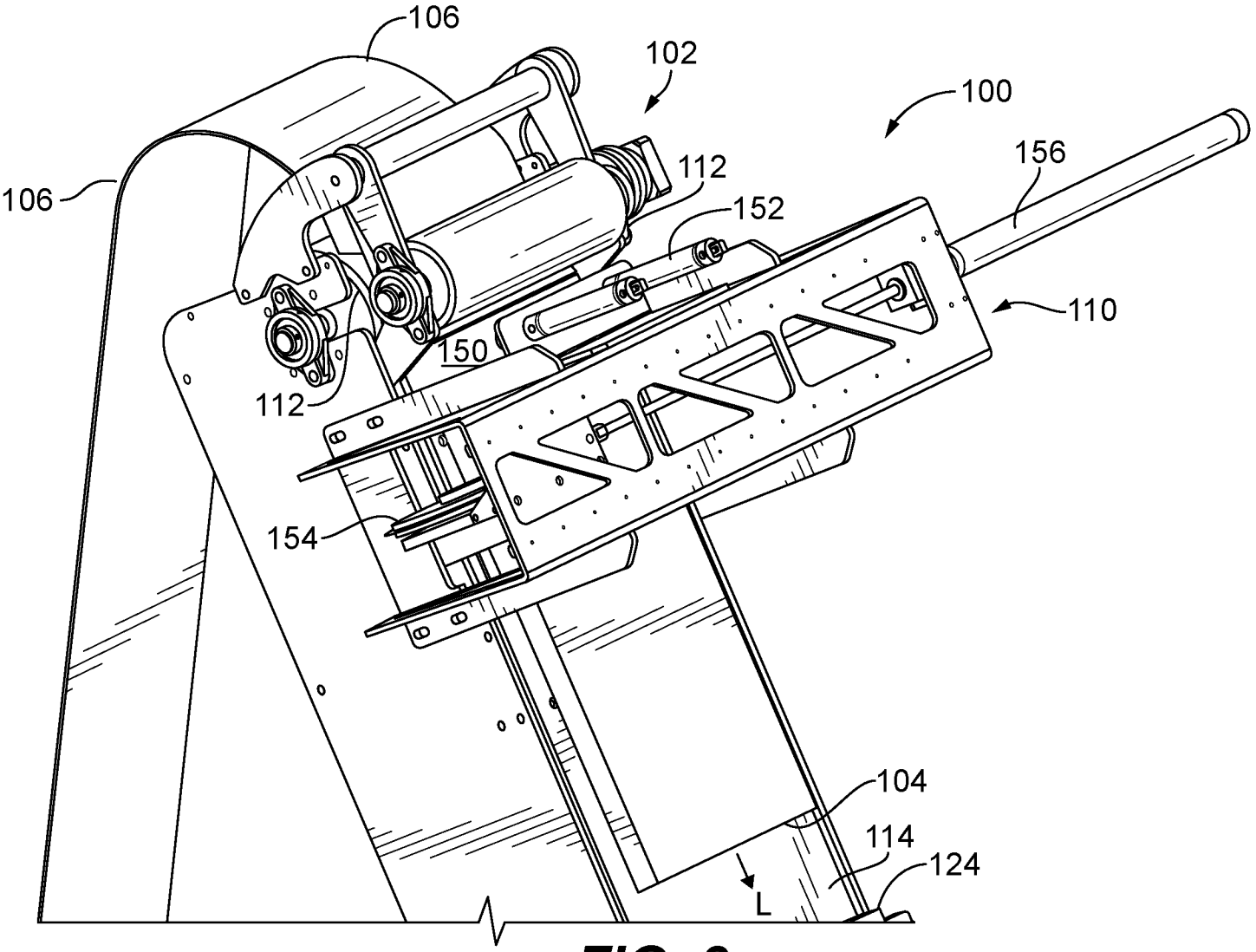
FIG. 3 is a perspective view of a portion of the system of FIG. 1, showing the first conveyor and the separator.

With reference now to FIG. 3, the separator 110 includes a retractable holder 150 driven toward and away from the slide 114 by a pair of linear actuators 152 for pressing the tube flat for cutting proximate the separator 110. The separator 110 includes a rotary knife 154 mounted to a mechanism to be driven relative to the cutter frame 148 by a linear actuator 156 oriented transverse to the longitudinal direction L of the tube 106 to cut the custom length of the tube 106. After each cut, the rotary knife 154 can remain clear to the side of the slide 114 to allow more of the tube 106 to pass into the separator 110. The rotary blade 154 can cut on each stroke, e.g., cut one pouch pre-form 124 on a forward stroke, and cut the next pouch pre-form 124 on the return stroke, or can return to the same side of the slide 114 after each cut.

Figure 4:
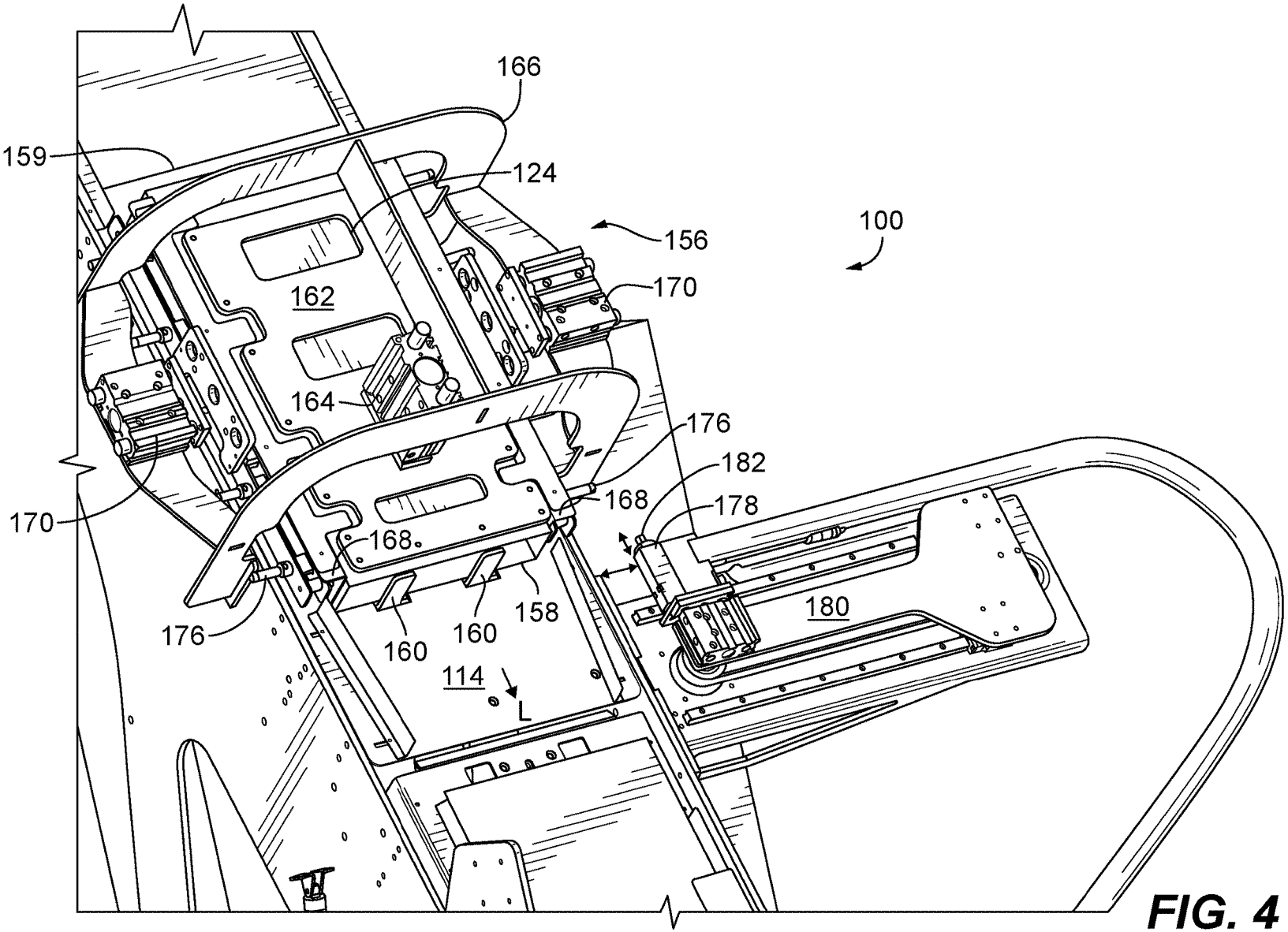
FIG. 4 is a perspective view of a portion of the system of FIG. 1, showing the first closer.

With reference now to FIG. 4, a first closer 156 is operatively connected to the separator 110 of FIG. 3 to receive the pouch pre-form 124 and close one end 158 of the of the pouch pre-form 124, leaving one end 159 of the pouch pre-form 124 open. The first closer 156 includes retractable tines 160 with an extended position, protruding from a portion of the slide 114, for receiving the pouch pre-form 124 from the separator 110 and holding the pouch pre-form 124 during erecting and closing one end 158 of the pouch pre-form 124. The tines 160 also have a retracted position, withdrawn into the slide 114, for allowing a pre-form 124 with one closed end 158 to pass out from the first closer 156.

Figure 5:
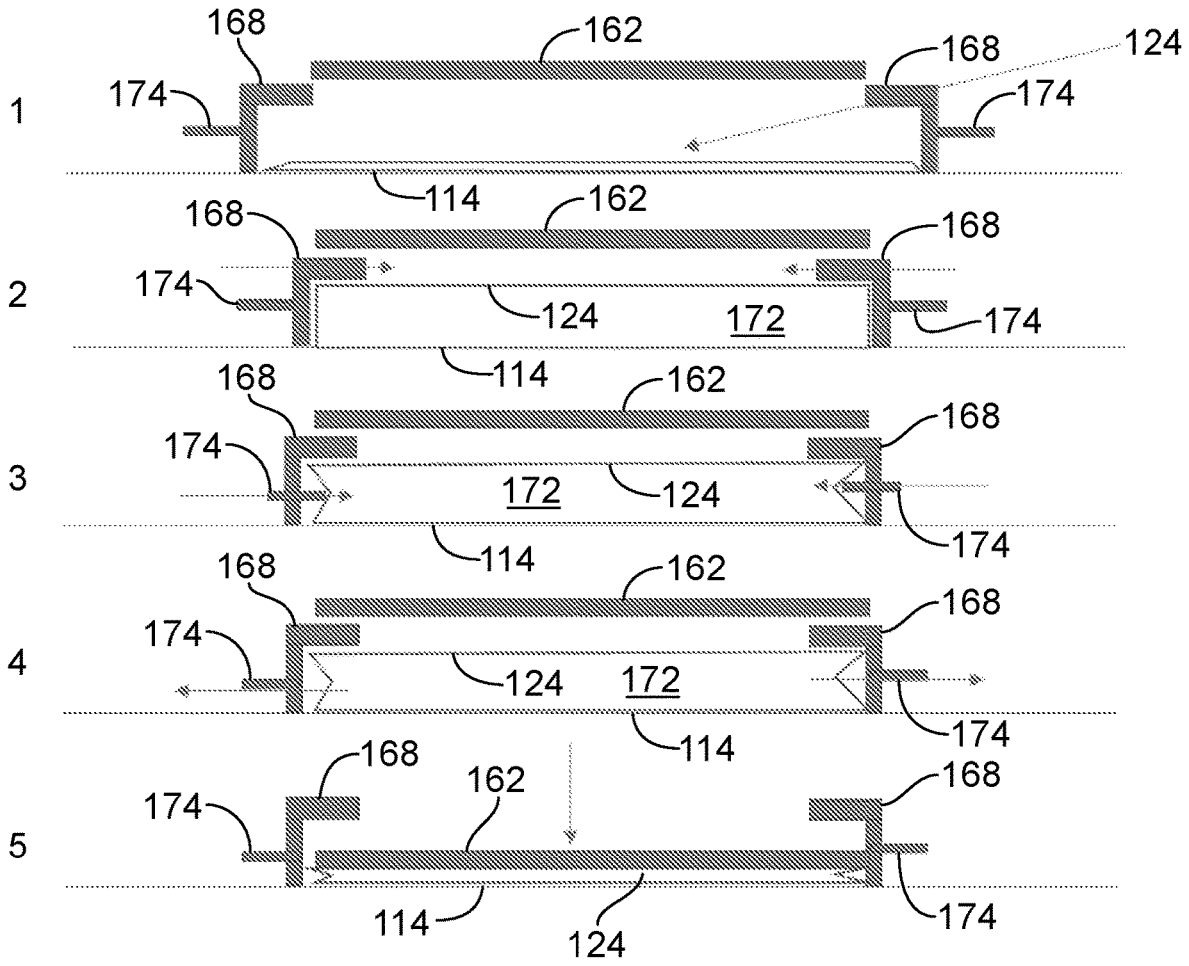
FIG. 5 is a schematic end view of a portion of the closer of FIG. 4, showing stages in erecting and closing a pouch pre-form.
Figure 6:
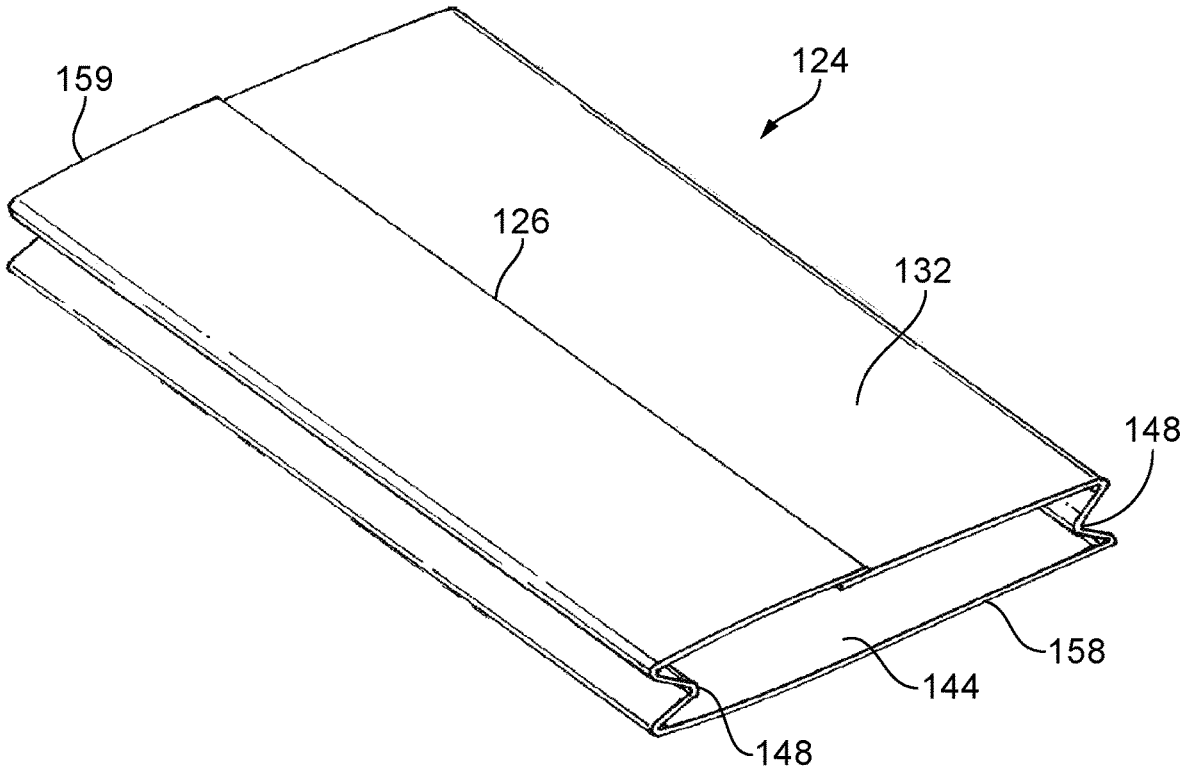
FIG. 6 is a perspective view of the pouch pre-form of FIG. 5, showing the pouch pre-form after being erected but prior to application of adhesive and closure.

The first closer 156 includes a closure plate 162 that is parallel to the slide 114. A linear actuator 164 moves the closure plate 162 into and out of the slide 114 relative to a frame 166 of the first closer 156 to press the pouch pre-form 124 flat after erecting the pouch pre-form 124 and after applying adhesive to close one end 158 of the pouch pre-form 124. An opposed pair of lateral plates 168 extend along the slide 114 on opposite lateral sides of the closure plate 162. The lateral plates 168 are ach connected to a respective linear actuator 170 for lateral movement relative to the frame 166 to laterally close inward on the pouch-preform to erect the pouch pre-form 124. FIG. 5 schematically shows a sequence for the closure plates 162 and lateral plates 168 to erect the pouch pre-form 124. The first stage in the sequence shows the pouch pre-form 124 in the flat condition. Optionally a flip plate in the slide 114 can flip one side of the pouch pre-form 124 upward from the slide 114 as indicated by the broke-line arrow in FIG. 5. Next the lateral plates 168 each move inward, forcing the pouch pre-form 124 into a rectangular condition, creating the interior space 172 that will eventually contain product. Side tines 174 next insert inward relative to the lateral plates 168, using linear actuators 176 shown in FIG. 4, to bend the pleat lines 148 (labeled in FIG. 2) inward. In the fourth stage shown in FIG. 5, the side tines 174 retract. With the pouch pre-form 124 erect, as shown in FIG. 6, adhesive can be applied to the inside surface of the first end 158 (labeled in FIG. 4).

With reference again to FIG. 4, the first closer 156 includes a laterally moving adhesive applicator 178 that is mounted to a linear actuator 180 for movement lateral to the longitudinal direction L. The applicator 178 includes an adhesive nozzle 182 that is itself mounted for movement in the longitudinal direction L so that the applicator 178 can move the nozzle 182 into alignment with the opening at the first end 158 of the pouch pre-form 124 (as indicated by the horizontal double arrows in FIG. 4) and then the nozzle 182 can then be actuated upward into the opening as (indicated by the vertical double arrows in FIG. 4). From this position just inside the opening, the nozzle 182 can apply adhesive to the inside surface of the first end 158 of the pouch pre-form 124, with the linear actuator 180 driving lateral movement for distribution of the adhesive along the width of the opening.

Figure 7:
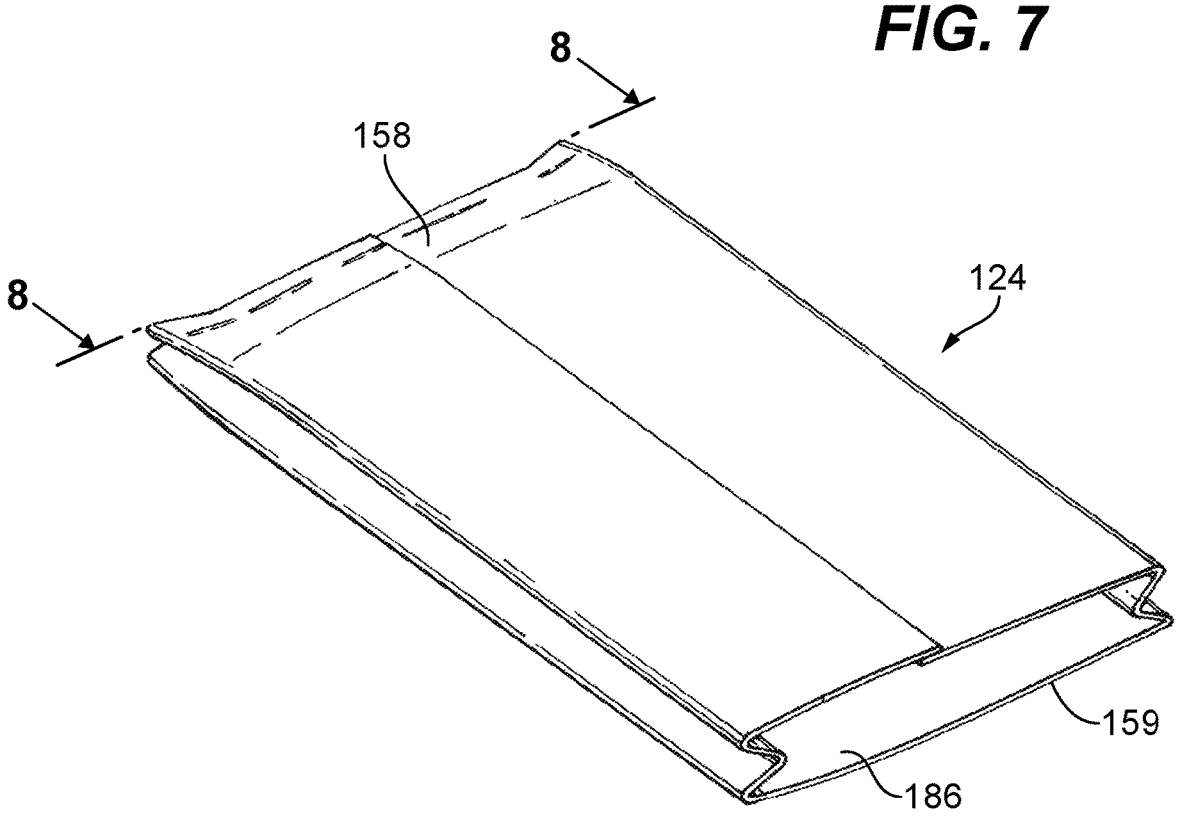
FIG. 7 is a perspective view of the pouch pre-form of FIG. 6, showing the pouch pre-form after application of adhesion and closure of the first end of the pouch pre-form.
Figure 8:
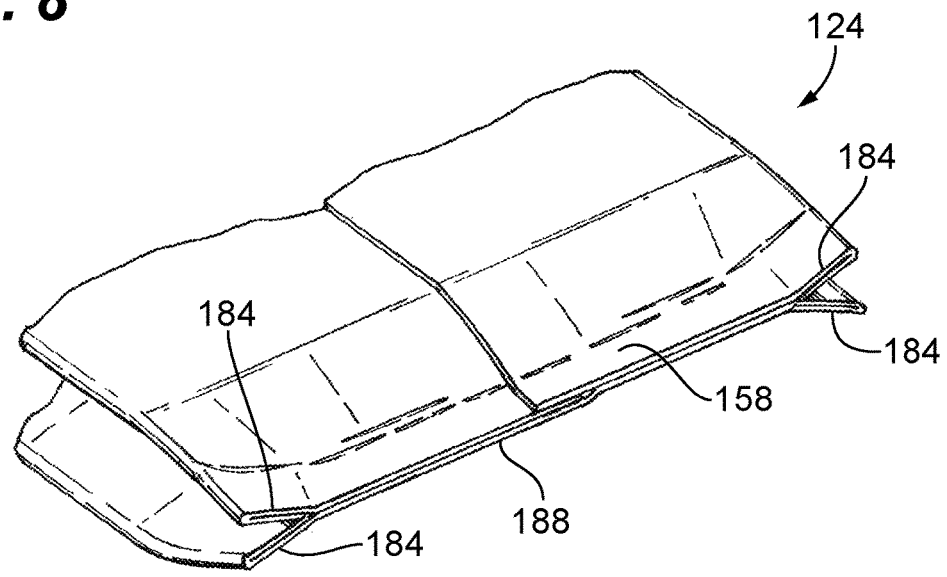
FIG. 8 is a perspective view of the pouch pre-form of FIG. 7, showing the closed first end.

With reference again to FIG. 5, with the adhesive in place, in the fifth stage shown in FIG. 5, the closure plate 162 presses the pleated pouch pre-form against the slide 114 to adhere the first end 158 to itself for closure of the first end 158 of the pouch pre-form 124. The one closed end (end 158) is the lower end with respect to the direction of gravity. FIG. 7 shows the pouch pre-form 124 after closing the first end 158. As shown in FIG. 8, the first end 158 of the pouch pre-form 124 includes four pleated portions 184 where the interior surface 186 (labeled in FIG. 7) is adhered in face to face position with itself on, two pleated portions 184 on either side of a main face-to-face adhered portion 188 of the interior surface 186 of the first end 158 of the pouch pre-form 124. Once the pouch pre-form 124 is closed at one end, it can drop along the slide 114 into the filling station 190 by retraction of the tines 160 (labeled in FIG. 4).

Figure 9:
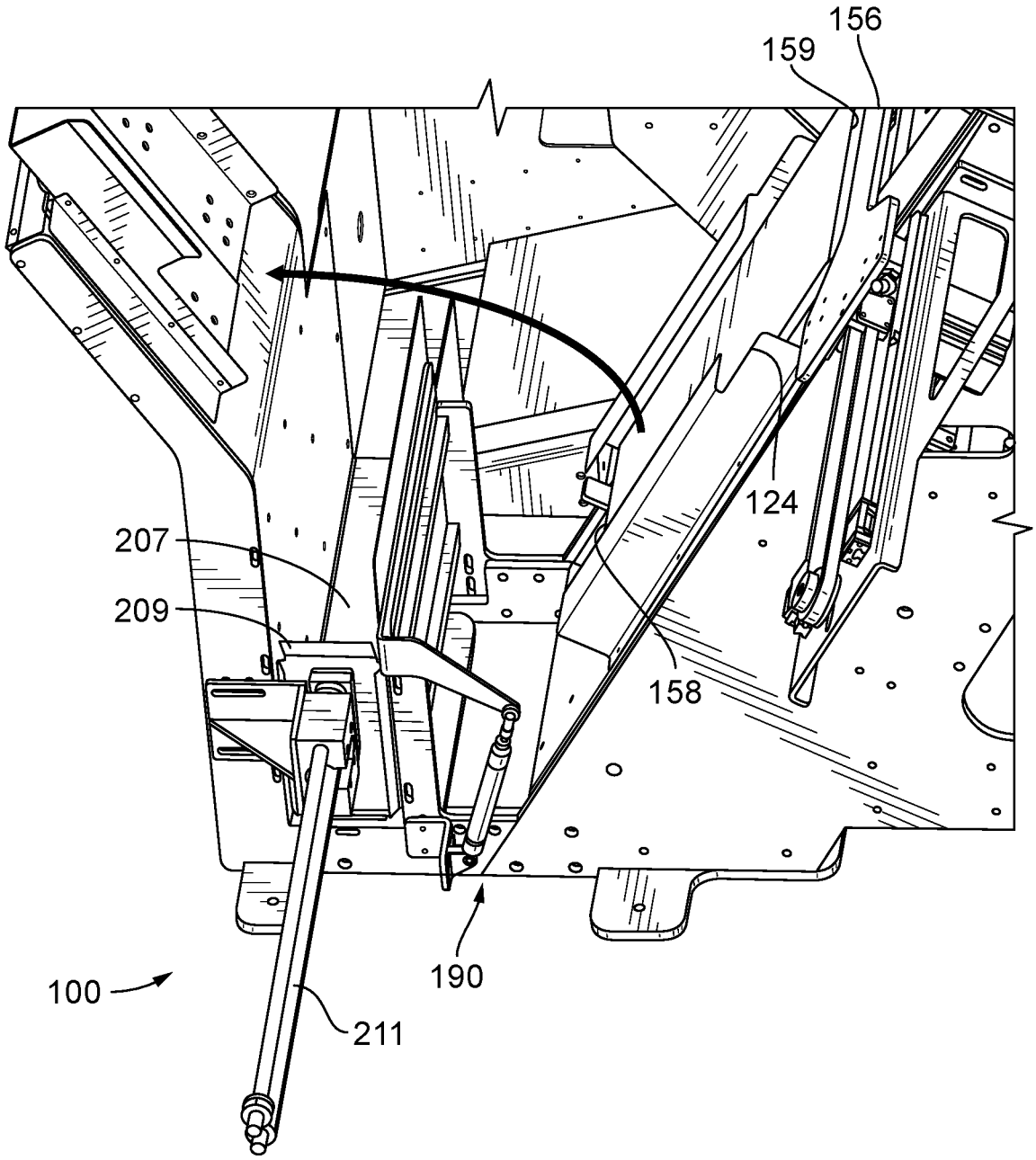
FIG. 9 is a perspective view of the system of FIG. 1, showing the filling station.

With reference now to FIG. 9, the filling station 190 is operatively connected to the first closer 156 to receive the pouch pre-form 124 and to present the open end 159 of the pouch pre-form 124 for receiving orders of product 120 (labeled in FIG. 1). The filling station 190 includes a pivot shuttle 192 configured to receive the closed end 158 of the pouch pre-form and flip the open end 159 of the pouch pre-form away from the first closer 156, e.g. to face the opening of the pouch pre-form 124 toward the user 194 as shown in FIG. 1. The movement of the pivot shuttle 192 is indicated in FIG. 9 by the large arrow, and is actuated by the linear actuator 191 identified in FIG. 10.

Figure 10:
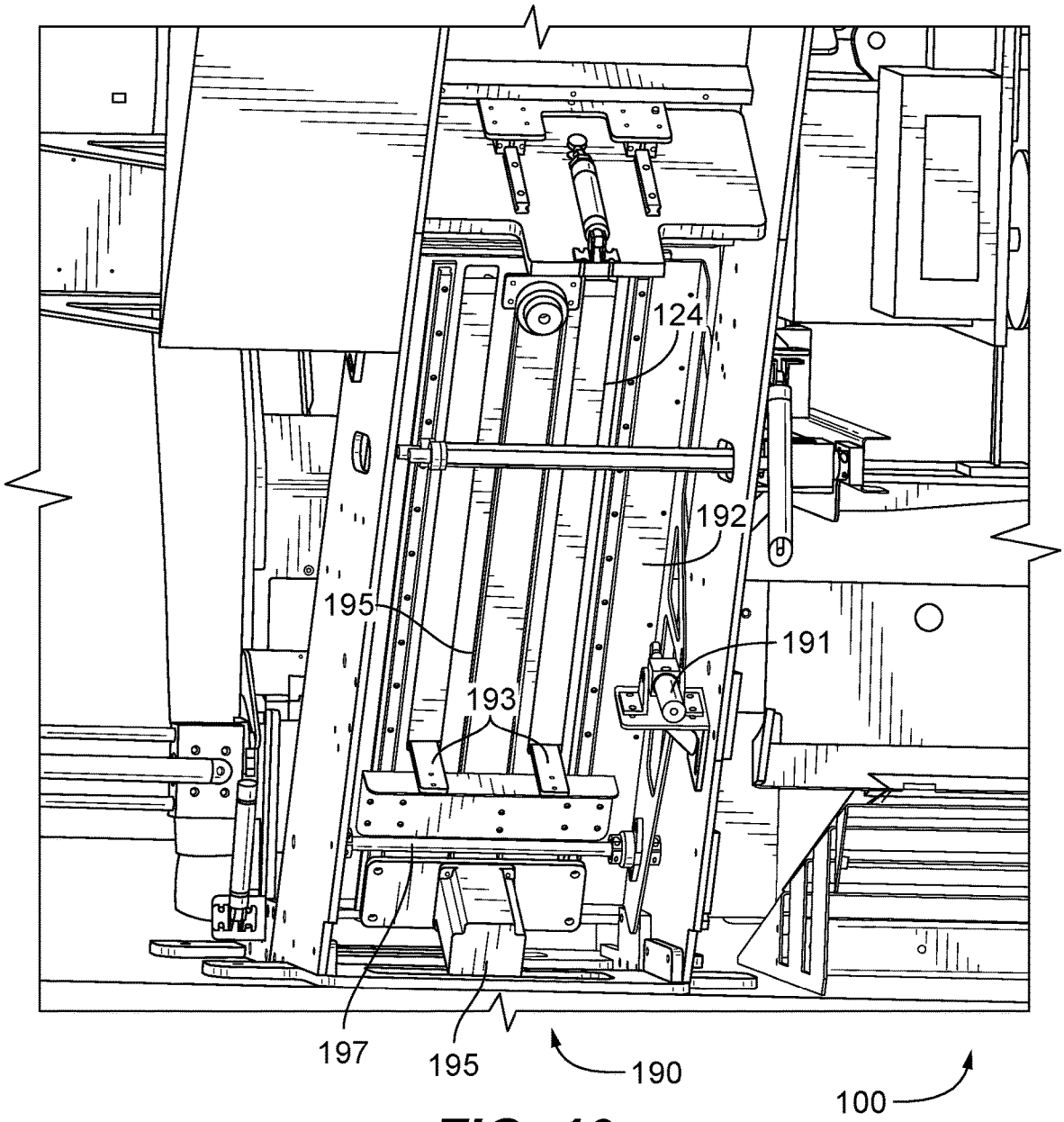
FIG. 10 is a perspective view of the system of FIG. 1, showing the filling station from a back side of the pivot shuttle.
Figure 11:
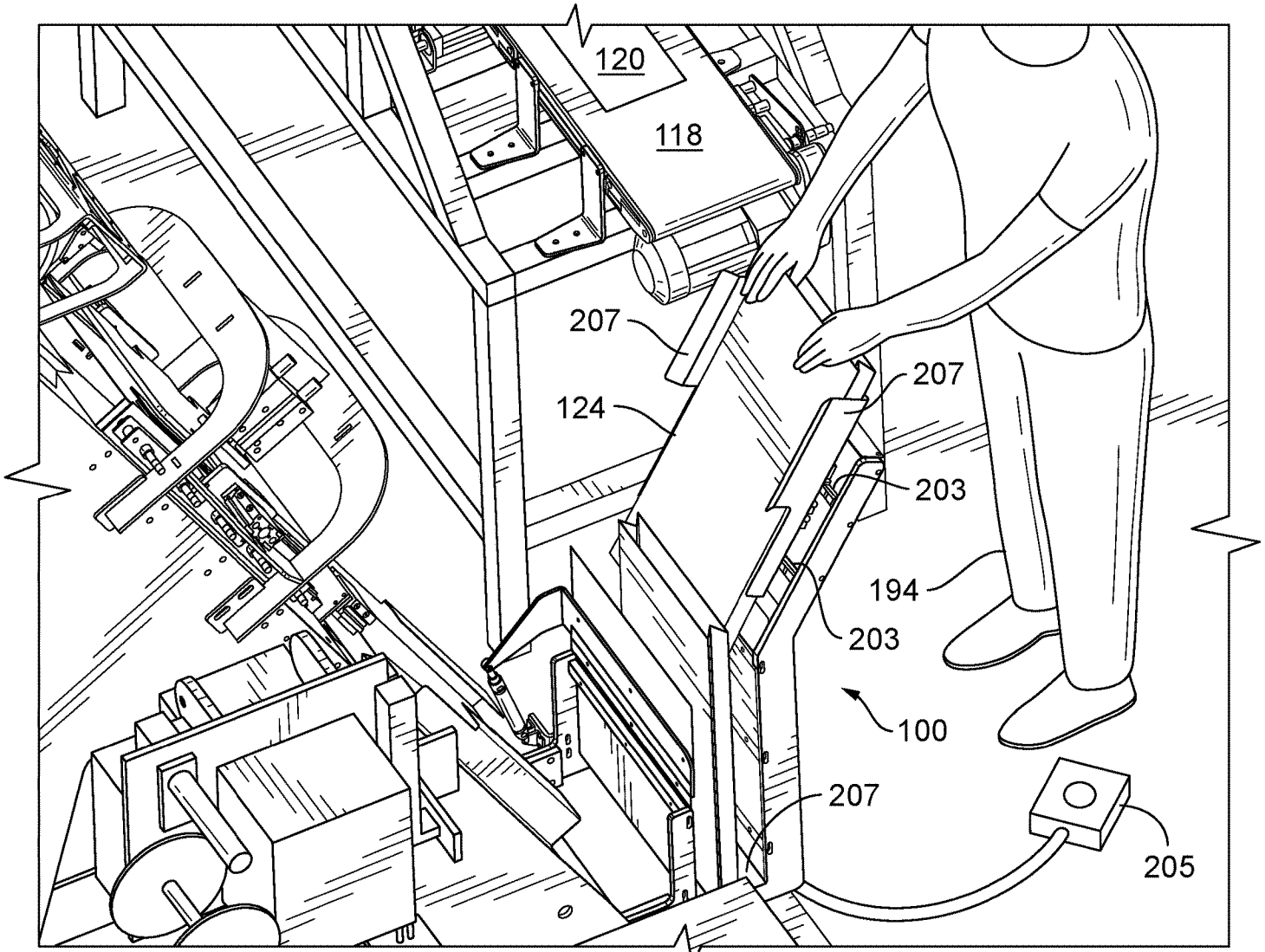
FIG. 11 is perspective view of the filling station of FIG. 9, showing a user and the second conveyor for filling the pouch pre-form with product.

With reference to FIGS. 9-11, the pouch pre-form 124 falls into the pivot tray 192 by the force of gravity onto two fingers 193 to the position shown in FIG. 9. The fingers 193 are attached to a belt driven actuator 195, each of which are labeled in FIG. 10. As indicated with the curved arrow in FIG. 9, the pivot shuttle 192 rotates about the pivot 197 (labeled in FIG. 10) under the force of the actuator 191, which can be a pneumatic cylinder, and then the fingers 193 move upward, driven by the actuator 195 (identified in FIG. 10), pushing the pouch pre-form 124 upward to the user 194 as shown in FIG. 11. Two opposed paddles 207 actuate inwards to squeeze the pouch pre-form 124 enough to hold it for loading. The paddles 207 are connected to linear actuators 203 for squeezing and releasing the pouch pre-forms 124.

The second conveyor 118 (identified in FIG. 1) is operatively connected to the filling station 190 to convey orders of product to the filling station 190. The user 194, or an automated system, place orders of product 120 from the second conveyor 118 into the open ends 159 of the pouch pre-forms 124 one after another, wherein each custom sized pouch pre-form 124 is presented to the user 194 when the corresponding order of product 120 arrives at the user's end of the second conveyor 118. With the paddles 207 holding the pouch pre-form 124 in the position shown in FIG. 11, the user 194 can place an order of product 120 in the open end of the pouch pre-form 124. Once the product is inside the pouch pre-form 124, the user can release the grip of the paddles 207, e.g., by pressing the foot button 205, to drop the filled pouch pre-form 124 down into the tray 207.

Figure 12:
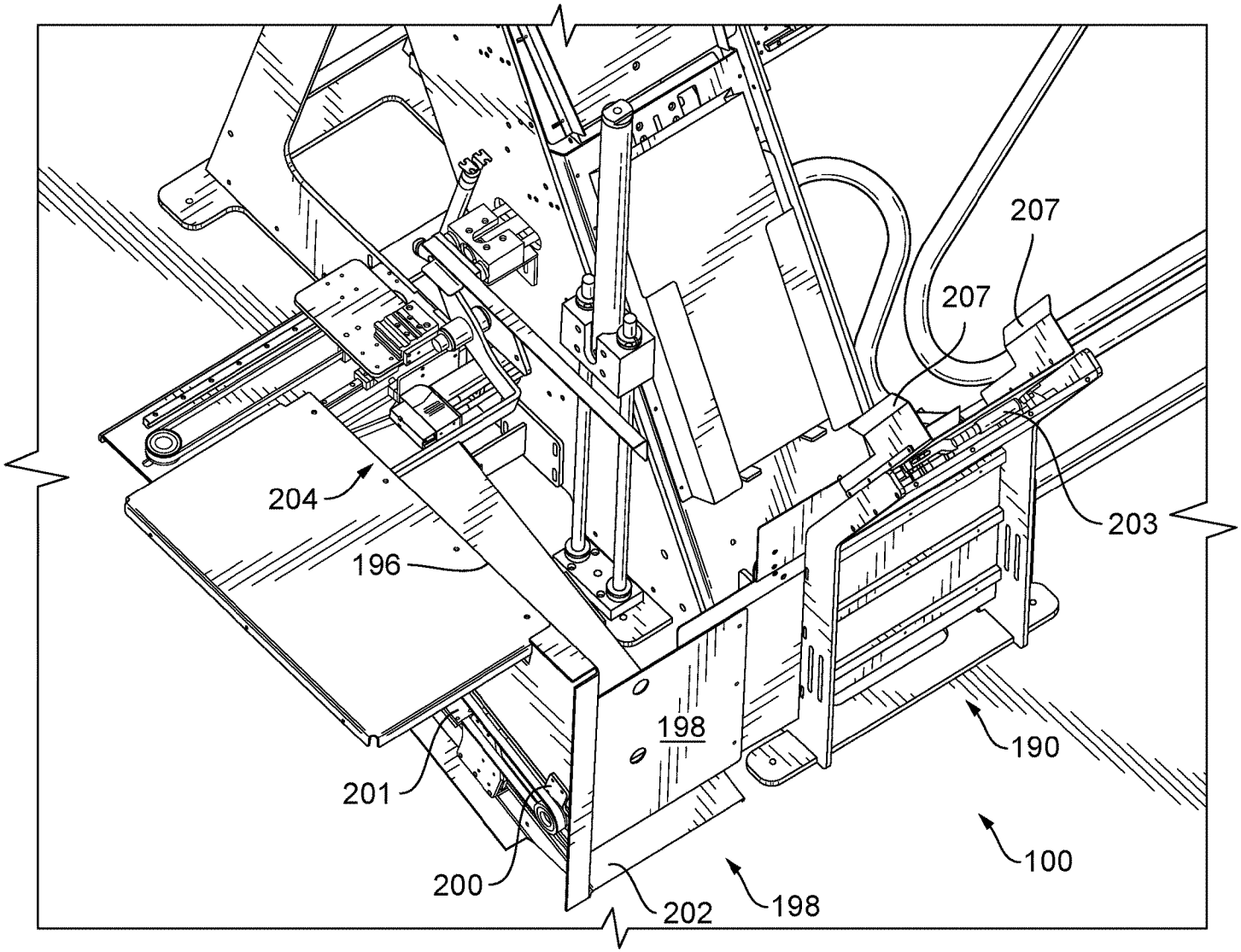
FIG. 12 is a perspective view of the system of FIG. 1, showing the second closer.

With reference now to FIG. 12, a third conveyor 198 is operatively connected to the filling station 190 to receive partially closed pouches 196 with product therein and convey the partially closed pouches 196 away from the filling station 190. The third conveyor includes a pusher 209 driven by a linear actuator 211 (both identified in FIG. 9) that drives the pouch 196 laterally off of tray 207 onto the ramp 202 in bin 198. The linear actuator 211 can be a pneumatic cylinder or any other suitable type of actuator. A belt drive 200 of the third conveyor 198 drives each pouch 196 up the ramp 202 into a second closer 204 using a trolley 201 affixed to the belt drive 200. The second closer 204 includes a similar adhesive applicator 206 on a linear actuator 208 and nozzle to that described above with respect to FIG. 4.

Figure 13:
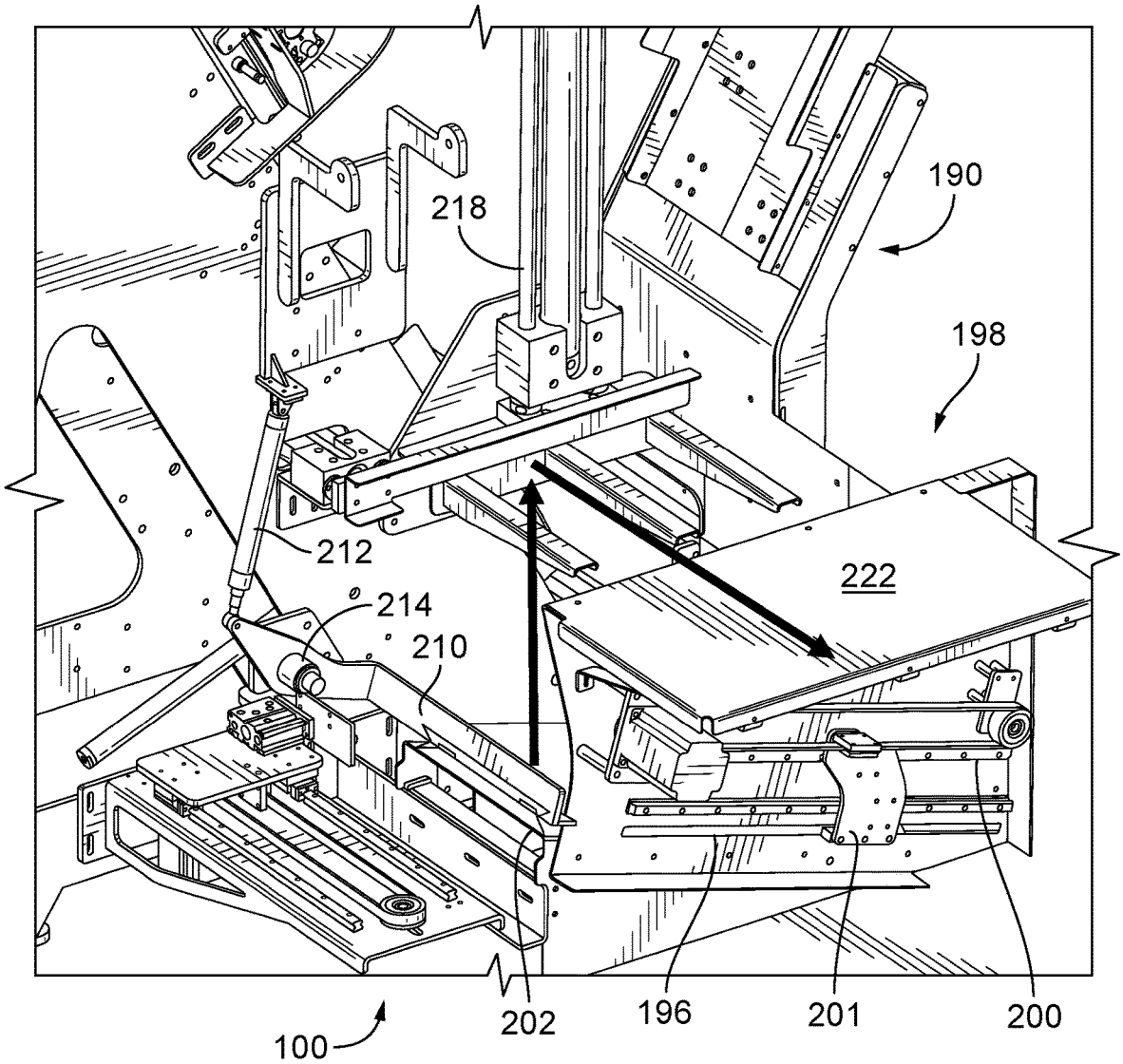
FIG. 13 is a perspective view of the second closer, schematically showing egress of a closed pouch containing product from the second closer.
Figure 14:
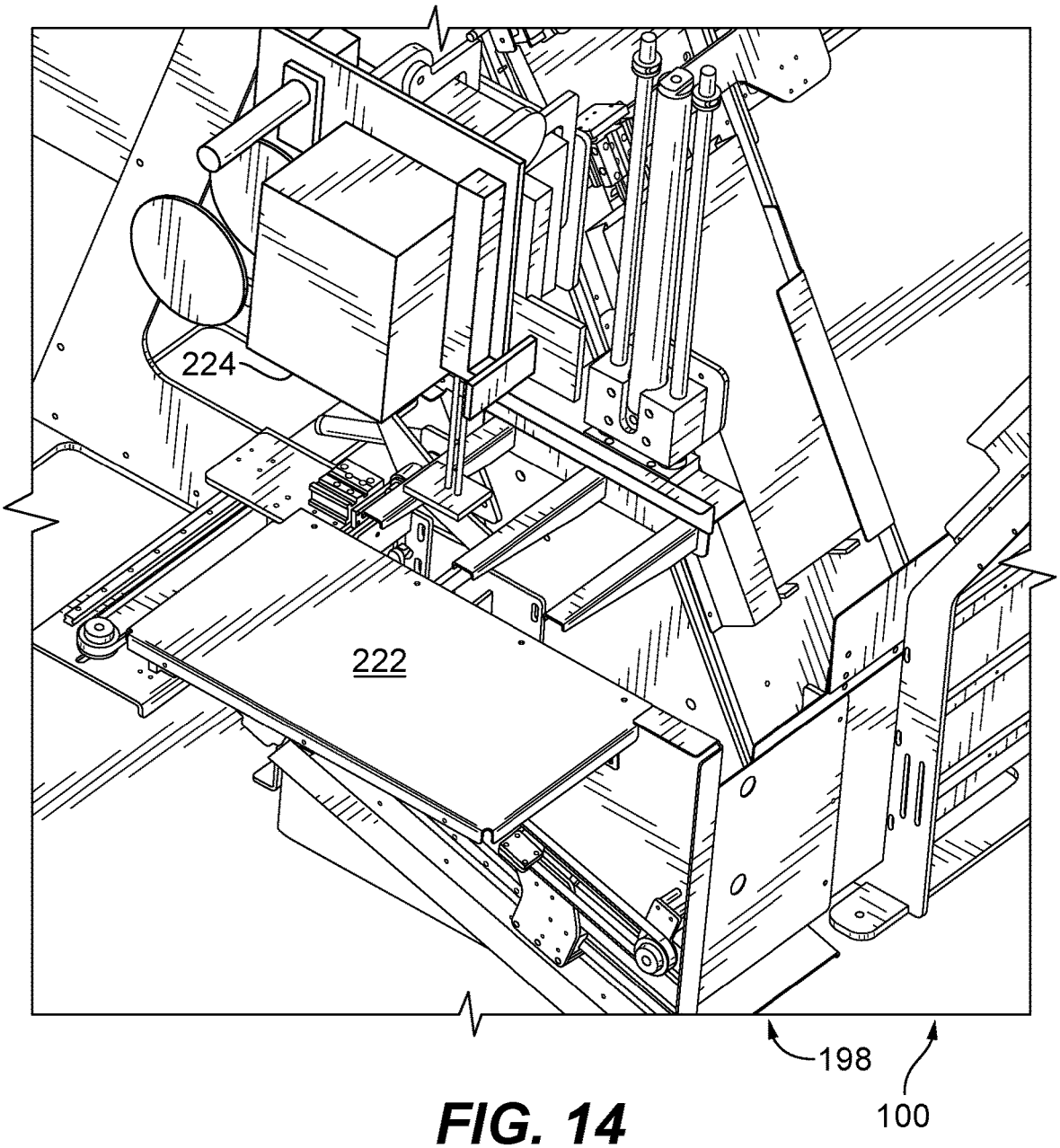
FIG. 14 is a perspective view of the system of FIG. 1, showing the labeler.

Referring now to FIG. 13, after applying adhesive to the open end 159 of the pouch 196, a closer bar 210, driven about a pivot 214 by a linear actuator 212, presses the open end 159 against the ramp 202 close the open end of the pouch 196 to produce a closed pouch 196 with product therein. The second closer closes the open end 159 so that it has the same closed configuration as that of the first end 158 shown in FIG. 8. After the pouch 196 is closed, the rack 216 (schematically shown above the pouch 196 in FIG. 13 for sake of clarity) lifts the pouch 196 using a linear actuator 218. Then a pusher bar 220 pushes the pouch 196 laterally onto the table 222. This upward then lateral motion of the pouch 196 is indicated by the large arrows in FIG. 13. The third conveyor 198 includes a labeler 224 above the table 222 configured to affix mailing information, e.g. by affixing or printing a shipping label or other indicia onto each of the closed pouches 196 (not shown in FIG. 14, but see FIG. 13). A fourth conveyor, not pictured for sake of clarity in the views, but similar to the second conveyor 118 of FIG. 1 and indicated schematically by the large arrow in FIG. 1, receives each labeled pouch 196 as the next pouch is pushed by the pusher bar 220 onto the table 222.

The processes described above can be repeated for each order of product, wherein each product or order of products has bespoke dimensions. Each pouch is fit to the respective bespoke dimensions.

Figure 15:
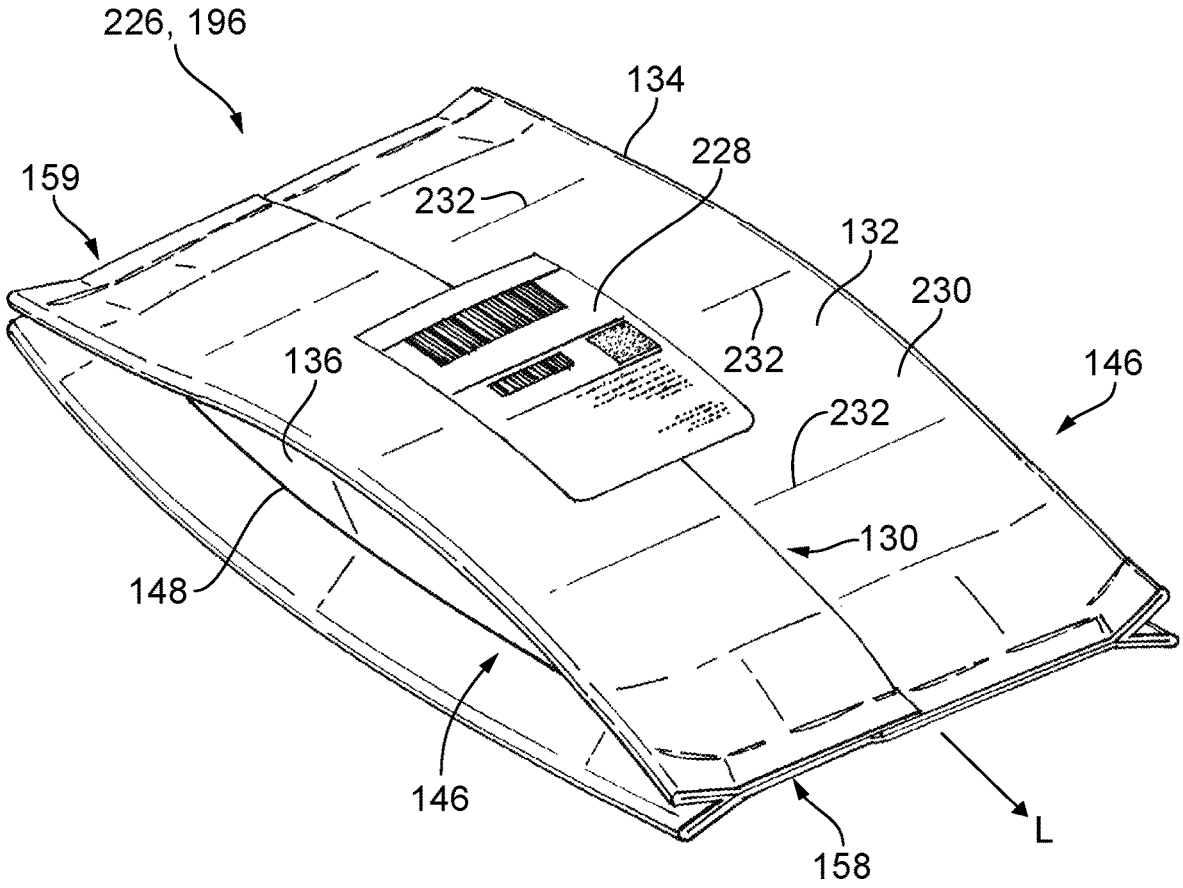
FIG. 15 is a perspective view of the pouch of FIG. 13, showing the pouch closed with product therein, and labeled for shipping.

With reference now to FIG. 15, the closed pouch 196 complete with a shipping label 228 on the outside and product inside forms a mailer 226 suitable for shipping in the mail or any suitable courier. The mailer 226 a single piece of corrugated paperboard 230, or any other suitable type of rigid tube form substrate such as solid fiber cardboard, wrapped around product. Two parallel, opposed edges 126, 128 (labeled in FIG. 2) of the single piece are adhered to one another to form a tube around an interior space for enclosing product. A first end 158 of the tube is adhered to itself to enclose a first end of the product. A second end 159 of the tube opposite the first end of the tube is adhered to itself to enclose a second end of the product.

The two parallel, opposed edges 126, 128 are adhered together to form a seam 130 in a first panel 132 of the tube along a first side of the product. The tube includes two side panels 146 each connected to the first panel 132 along a respective fold line 136,134. Each side panel 146 extends from the first end 158 of the tube to the second end 159 of the tube. Each side panel 146 includes an inward pleat formed by a fold line or pleat line 148 extending parallel to the seam 130 from the first end 158 of the tube to the second end 159 of the tube. Those skilled in the art will readily appreciate that the label 228 can be placed on the opposite panel 144 (labeled in FIG. 2), instead of the first panel 132. The corrugation lines 232, only some of which are indicated in FIG. 15, in the tube run lateral to the longitudinal direction L of the seam 130 to facilitate forming the closures on the ends 158 and 159 of the mailer 226.

Figure 16:
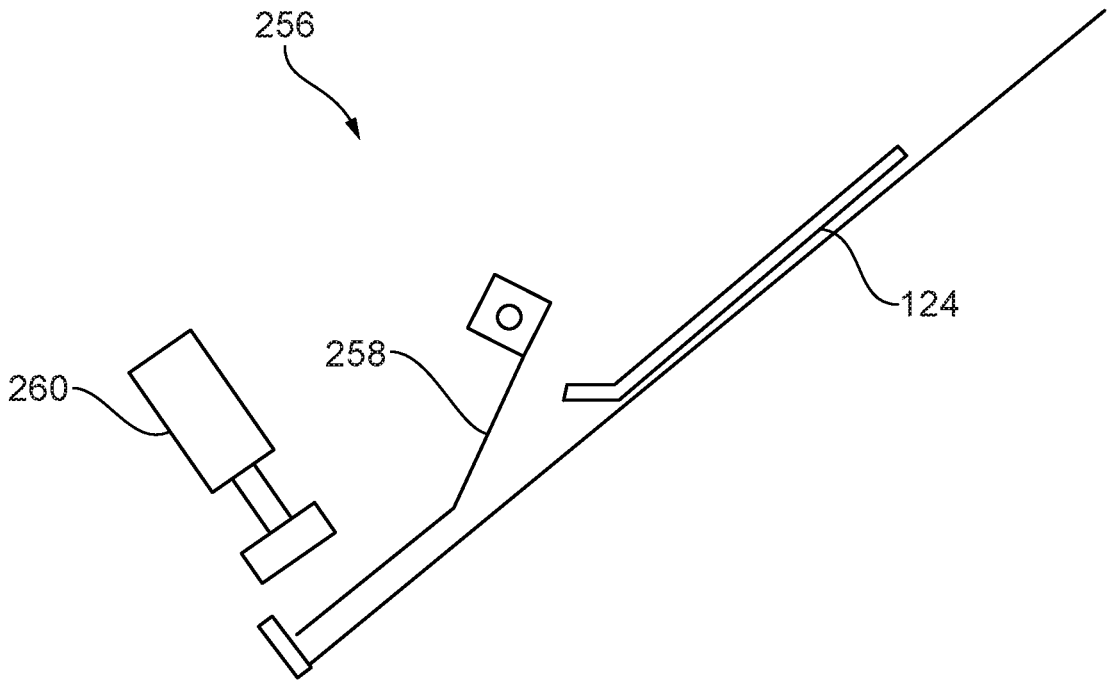
FIGS. 16-18 are schematic side-elevation views of another exemplary embodiment of a system constructed in accordance with the present disclosure.
Figure 17:
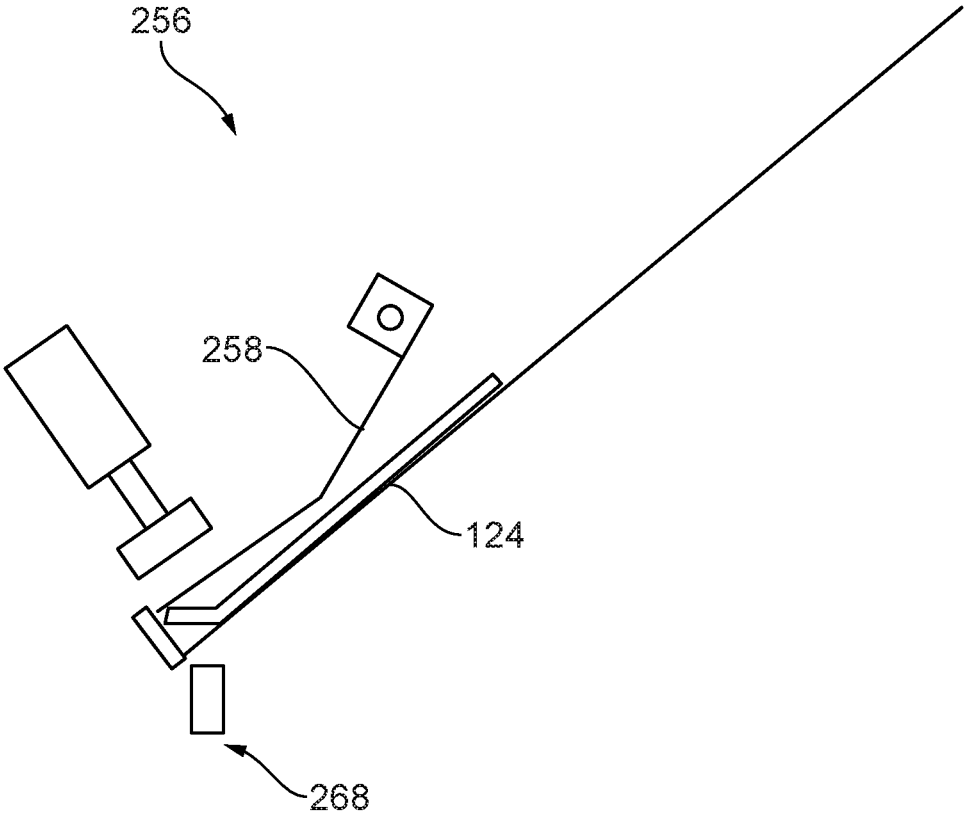
Figure 18:
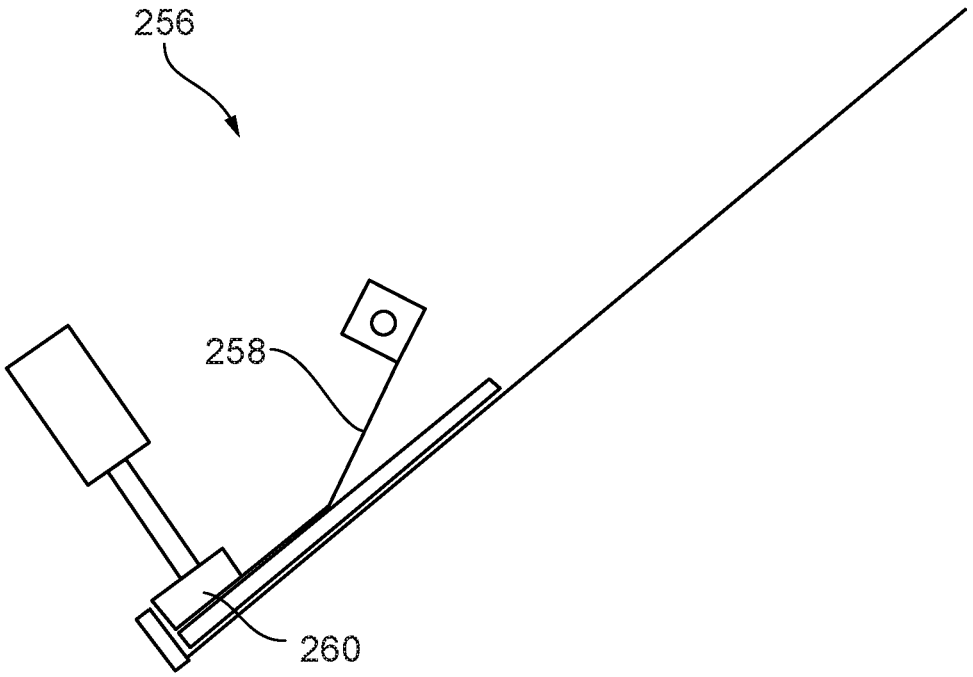
Figure 19:
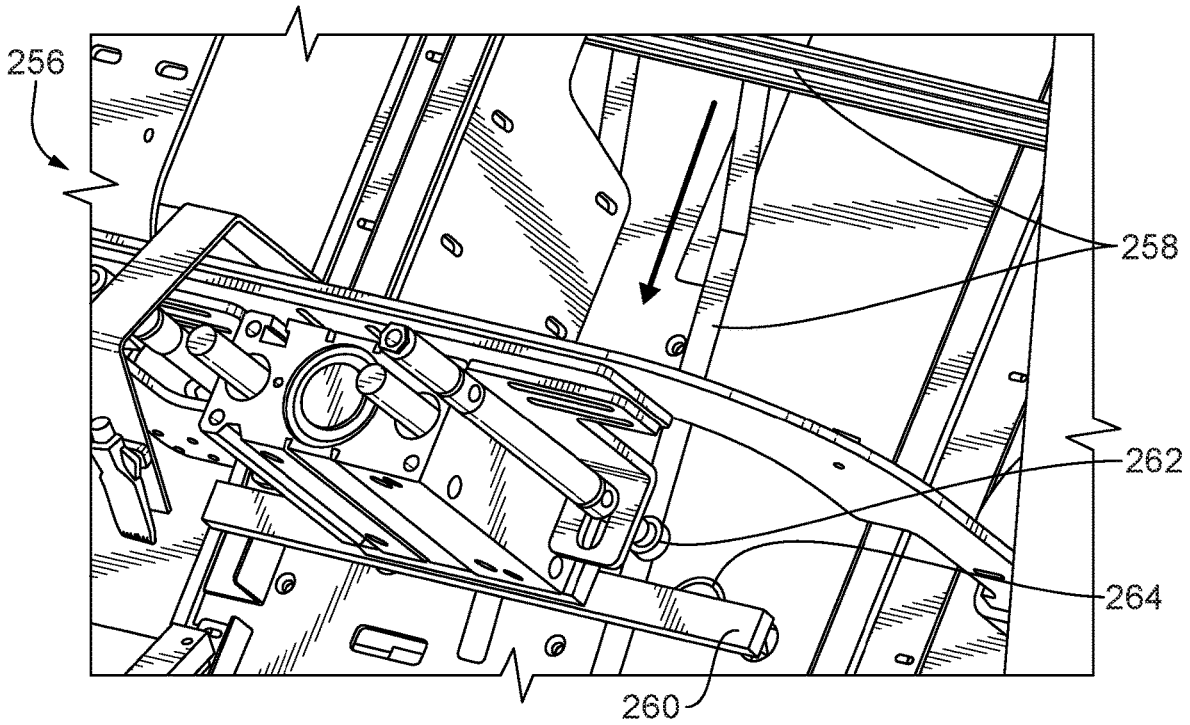
FIG. 19 is a perspective view showing stages of closing a first end of the pouch pre-form.
Figure 20:
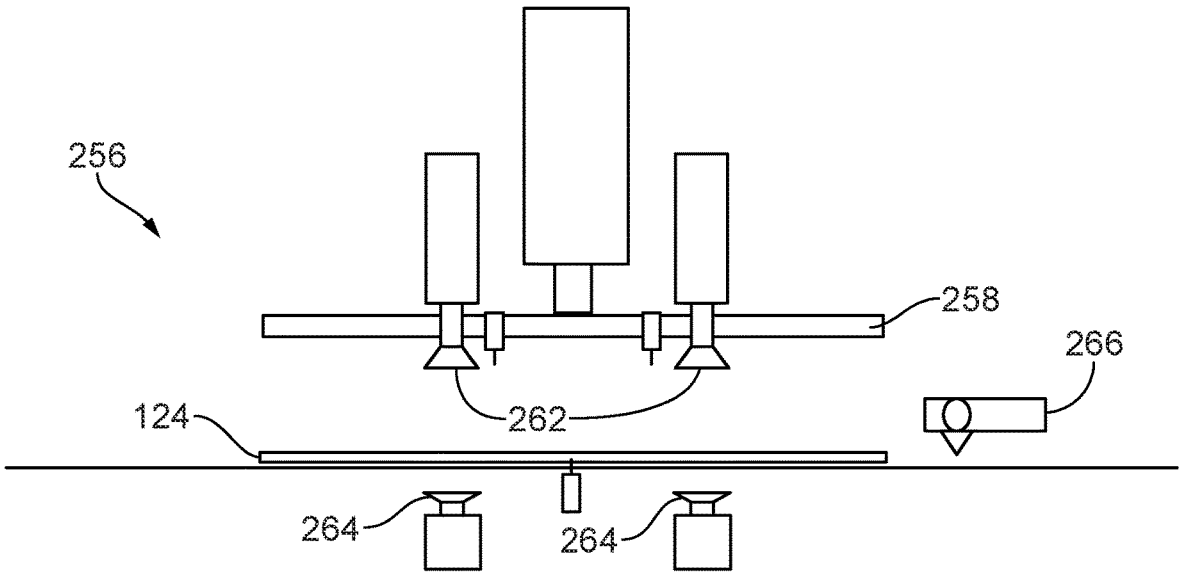
FIGS. 20-24 are schematic end-elevation views of the system of FIGS. 16-19, showing stages of admitting a glue dispenser into one end of the pouch pre-form.

Referring now to FIG. 16, it is contemplated that a different first closer 256 can be used in lieu of the first closer 156 described above with reference to FIGS. 4-5. The pouch after cut drops into the first closer 256, which is a first glue station. Just prior to the glue station 256 there are small metal fingers 258 that hang down above the pressure bar and glue head 266 and in opposition to the slide 125. These fingers 258 guide the cut pouch pre-form 124 into the glue station 256 and assist in forcing the pouch pre-form 124 flat against the slide 125 if there is unwanted upward memory, e.g. from an unwanted score, in the material. The pouch preform 124 moves under the fingers 258 into the position shown in FIG. 17. The pressure bar 260 actuates and forces the fingers 258 against the non-confirming upward memory of the pouch pre-form 124. The pressure bar 260 then retracts for the gluing process described with reference to FIGS. 20-24 below. FIG. 19 shows the direction of the movement of the pouch pre-form 124 in FIGS. 16-18.

Figure 21:
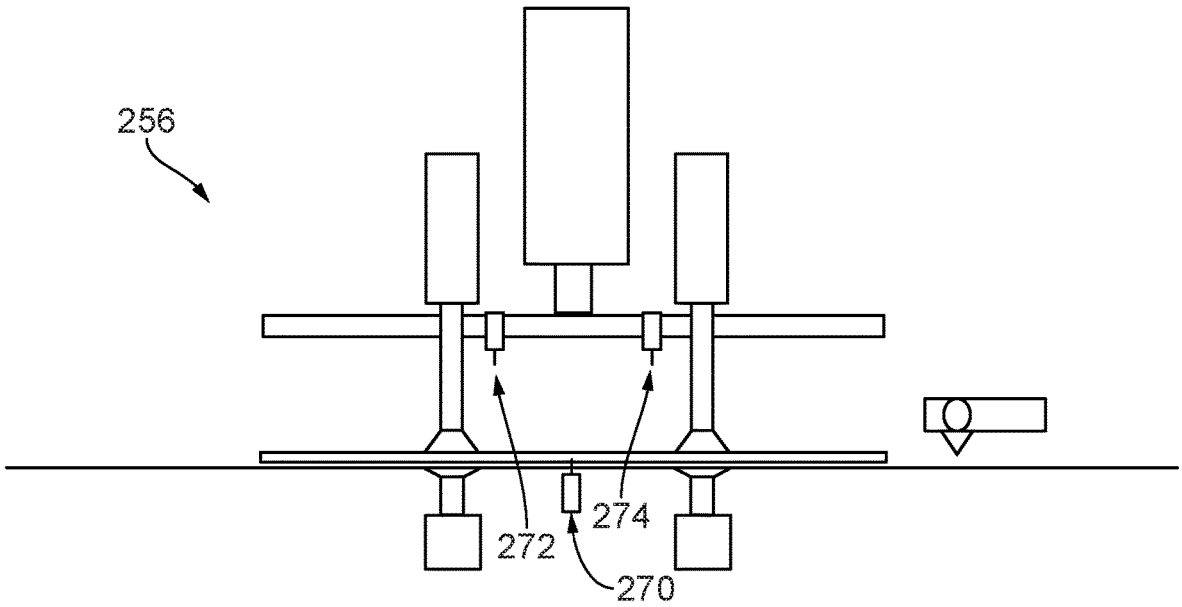
Figure 22:
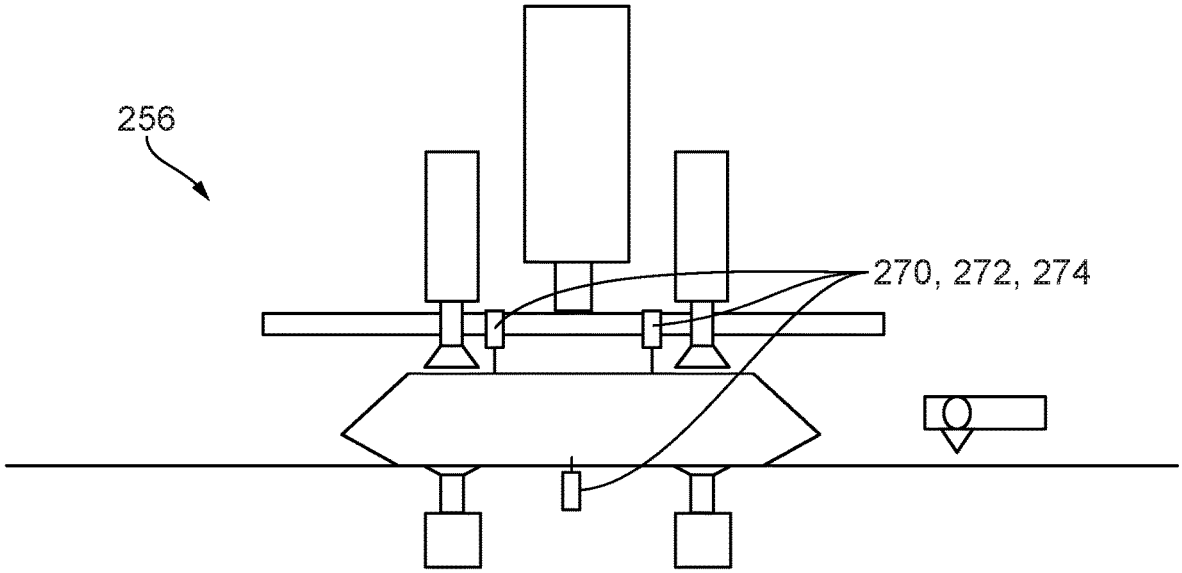
Figure 23:
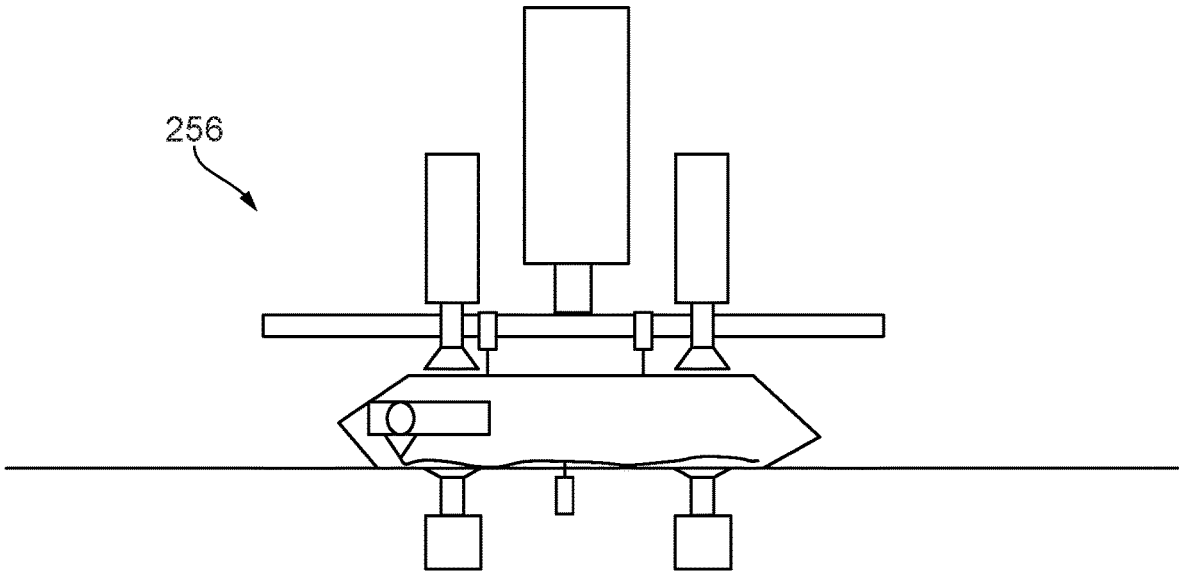
Figure 24:
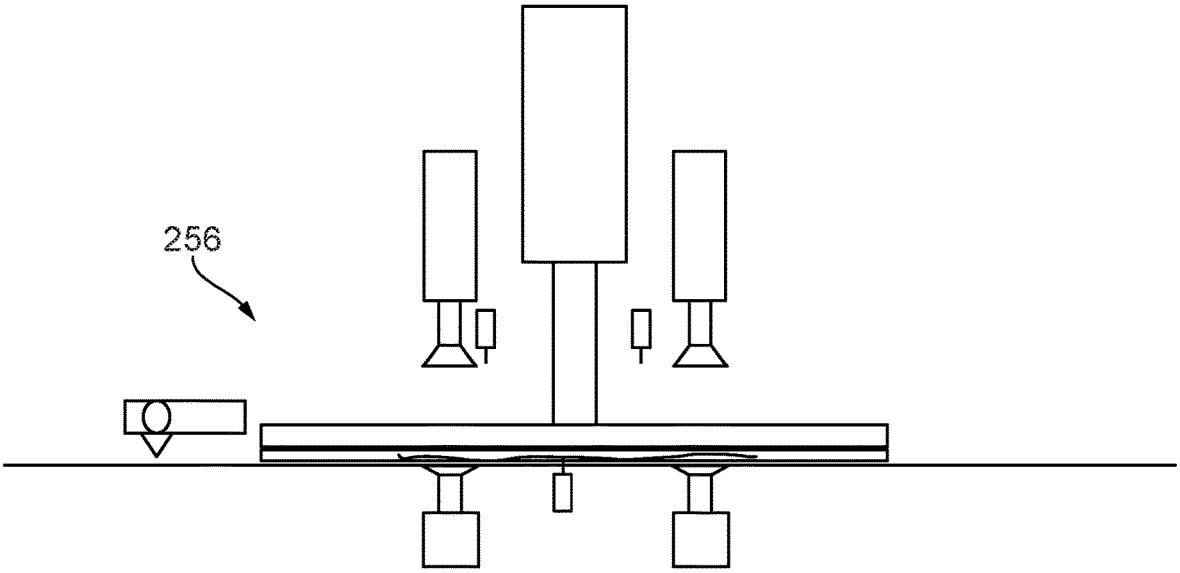

With reference now to FIGS. 20-24, top and bottom vacuum cups 262, 264 secure and open the pre-form pouch 124 to the position shown in FIG. 22. This allows for the glue head 266, or adhesive applicator, to insert into the lower end of the pre-form pouch 124 and apply glue to close that end of the pre-form pouch 124, as indicated in FIG. 23. The glue head 266 retracts from the opening of the pouch pre-form 124 and the pressure bar 260 actuates to press the bottom opening of the pre-form pouch 124 to close on the glue or adhesive, closing the pre-form pouch 124, as shown in FIG. 24.

There are four photosensors 268, 270, 272, 274 at the station 256. The first photosensor 268 (shown in FIG. 17) is positioned to detect that the pouch pre-form 124 has dropped from the first conveyor 102 and separator 110. The second photosensor 270 is positioned as shown in FIG. 21 to detect whether the bottom layer of the pouch pre-form 124 is in position to allow for glue head 260 insertion. The third and fourth photosensors 272, 274 are positioned to detect whether the top layer of the pouch pre-form 124 is in position to allow for glue head insertion 266.

Figure 25:
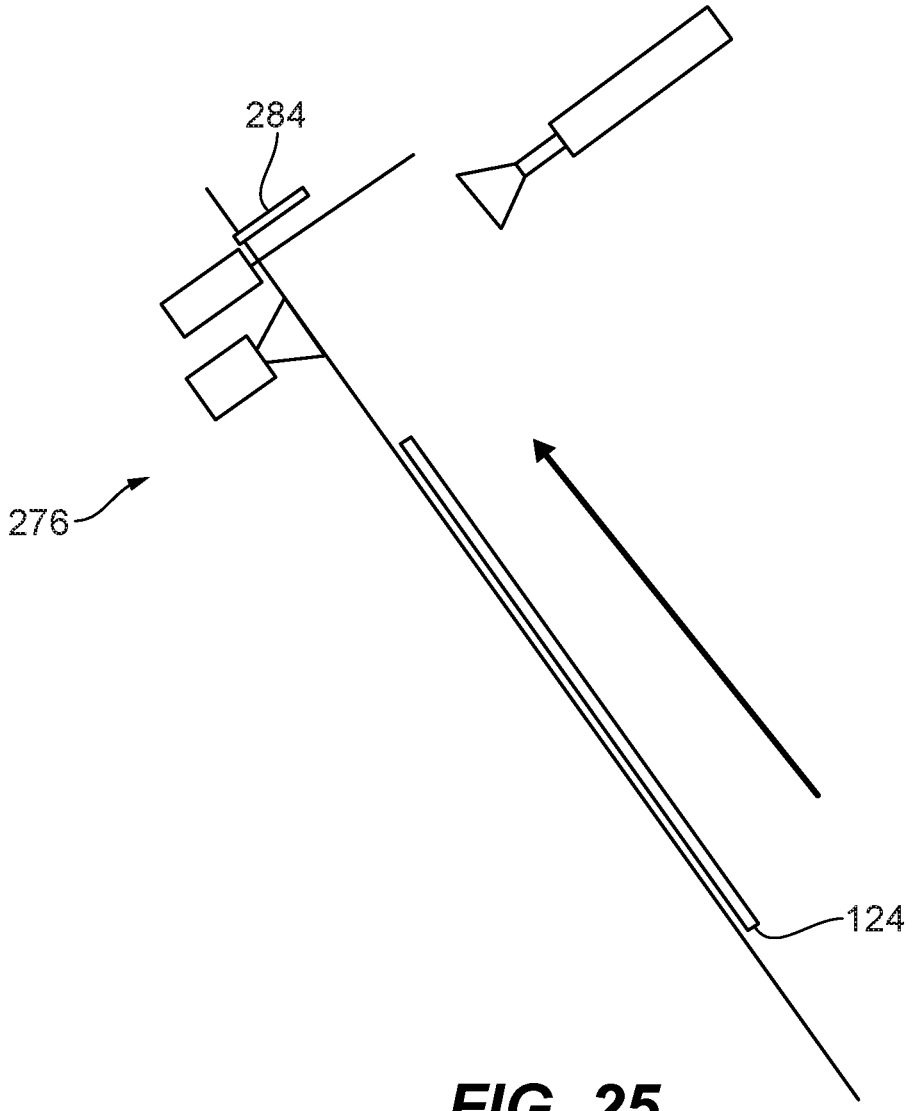
FIGS. 25-29 are schematic side-elevation views of the system of FIGS. 16-19, showing stages of opening a pouch pre-form at the operator loading station.
Figure 26:
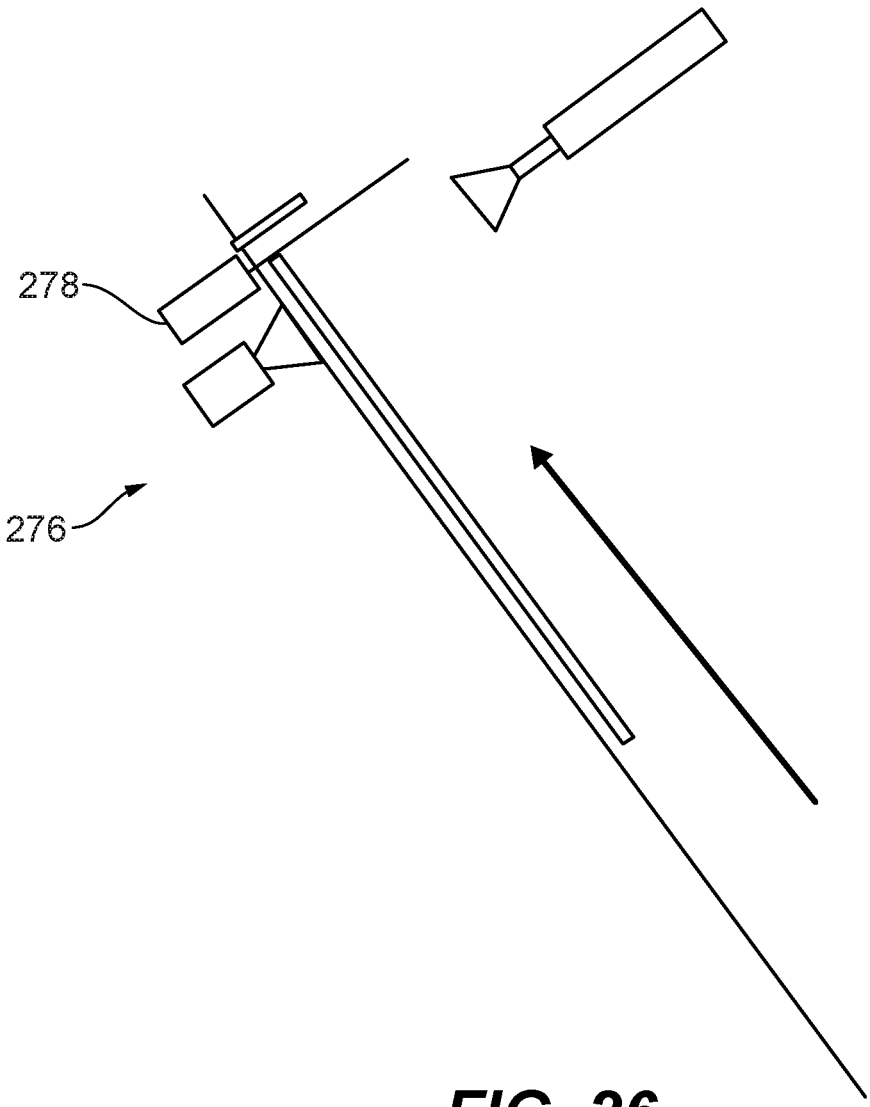
Figure 27:
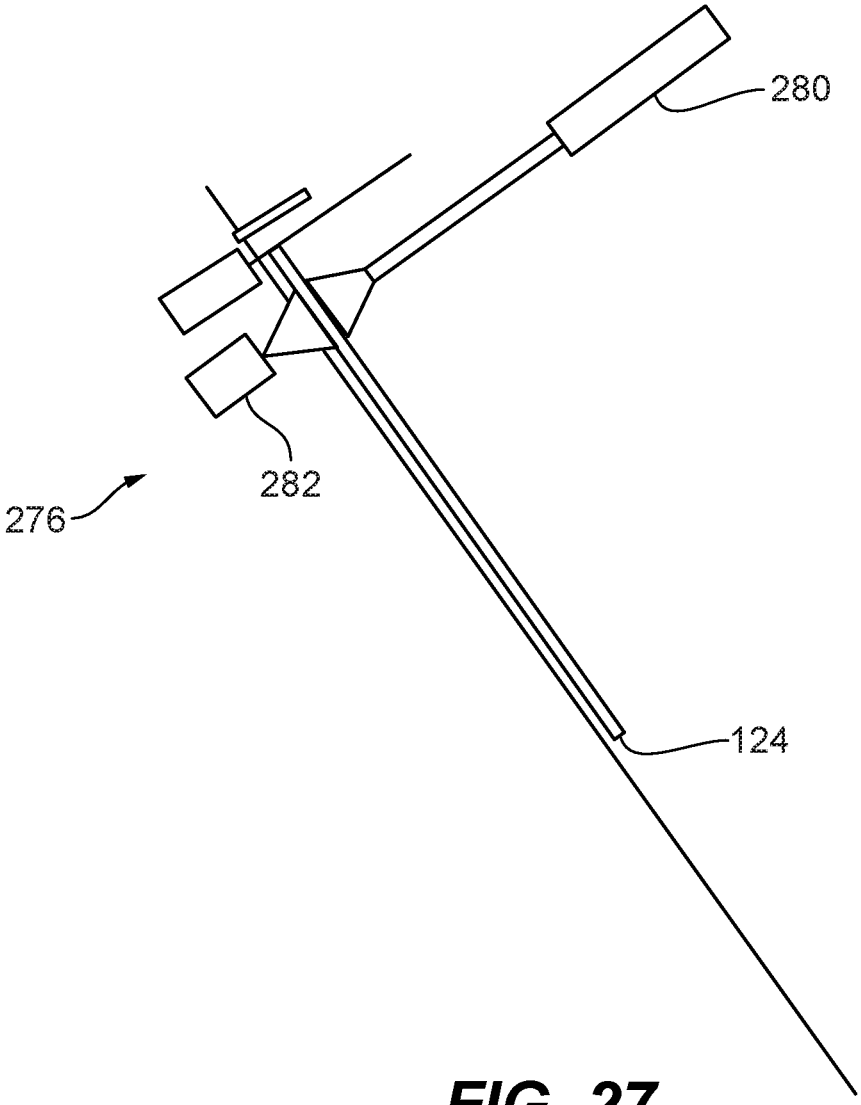
Figure 28:
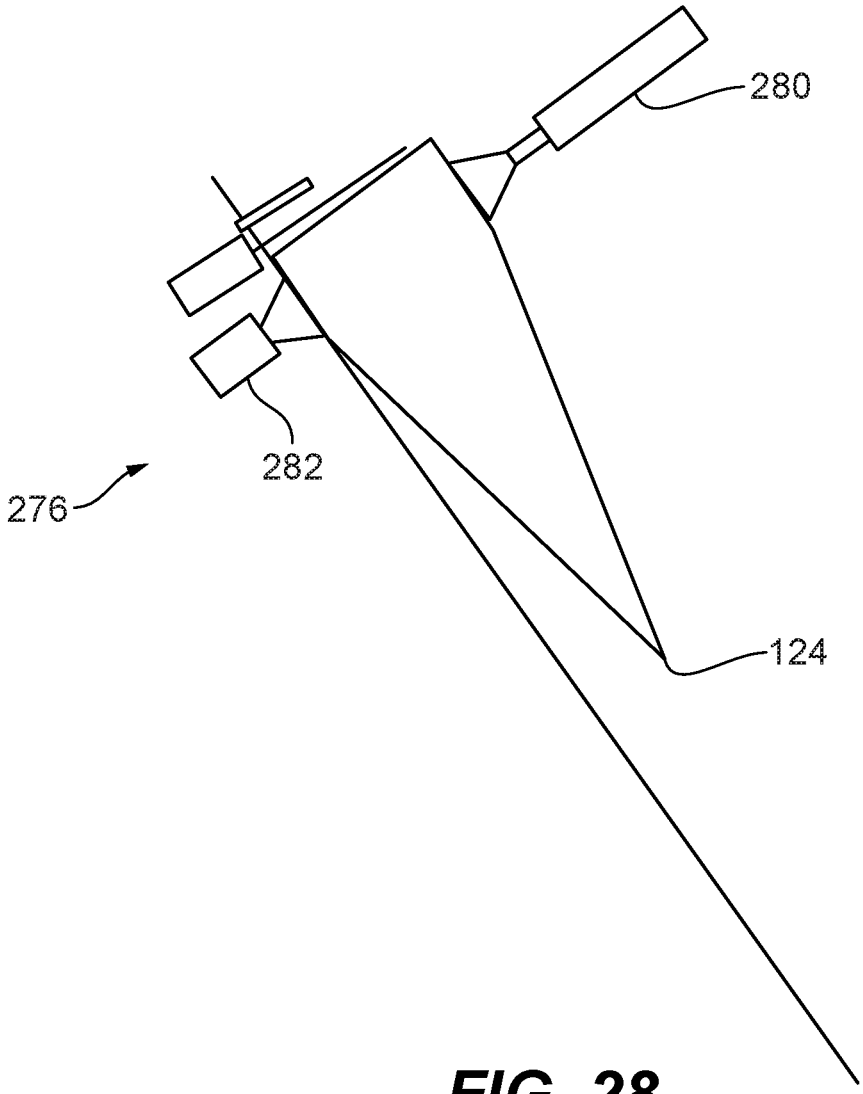
Figure 29:
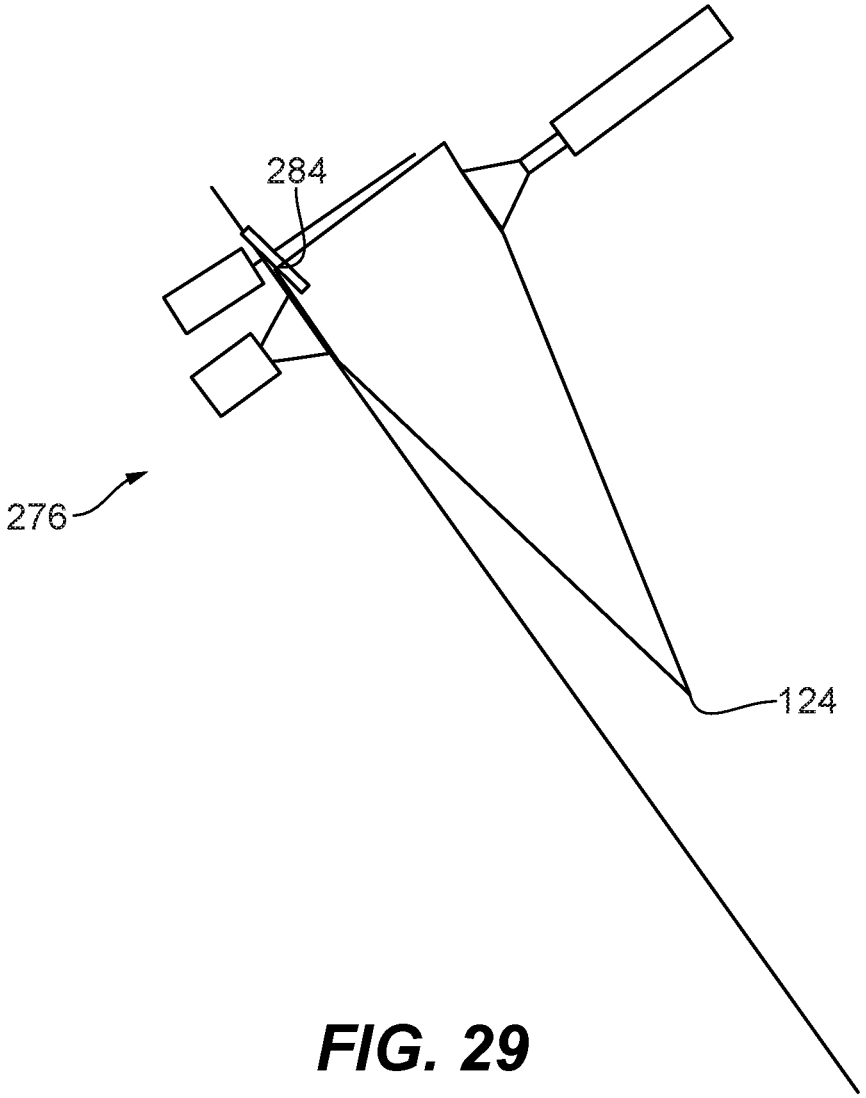

With reference now to FIGS. 25-29, an operator loading station 276 is shown that can be used in lieu of that described above with respect to FIG. 11, i.e., in lieu of paddles 207 holding a pouch pre-form 124 while a user 194 places contents into the pouch pre-form 124. As shown in FIG. 25, the pouch pre-form 124 approaches the operator loading station 276 in an upward direction. A photosensor 278 is at the final position point to register position of the pouch pre-form 124, as indicated in FIG. 26. When the photosensor 278 registers presence of the pouch pre-form 124, the pouch pre-form 124 is secured by opposed top and bottom vacuum cups 280, 282 as shown in FIG. 27, and opened as shown in FIG. 28 by pulling motion of the vacuum cups 280, 282. Then, as shown in FIG. 29, a clip 284 rotates into position, holding the lower portion of the opening of the pouch pre-form 124 while the operator fills the pouch pre-form with product or merchandise.

Figure 30:
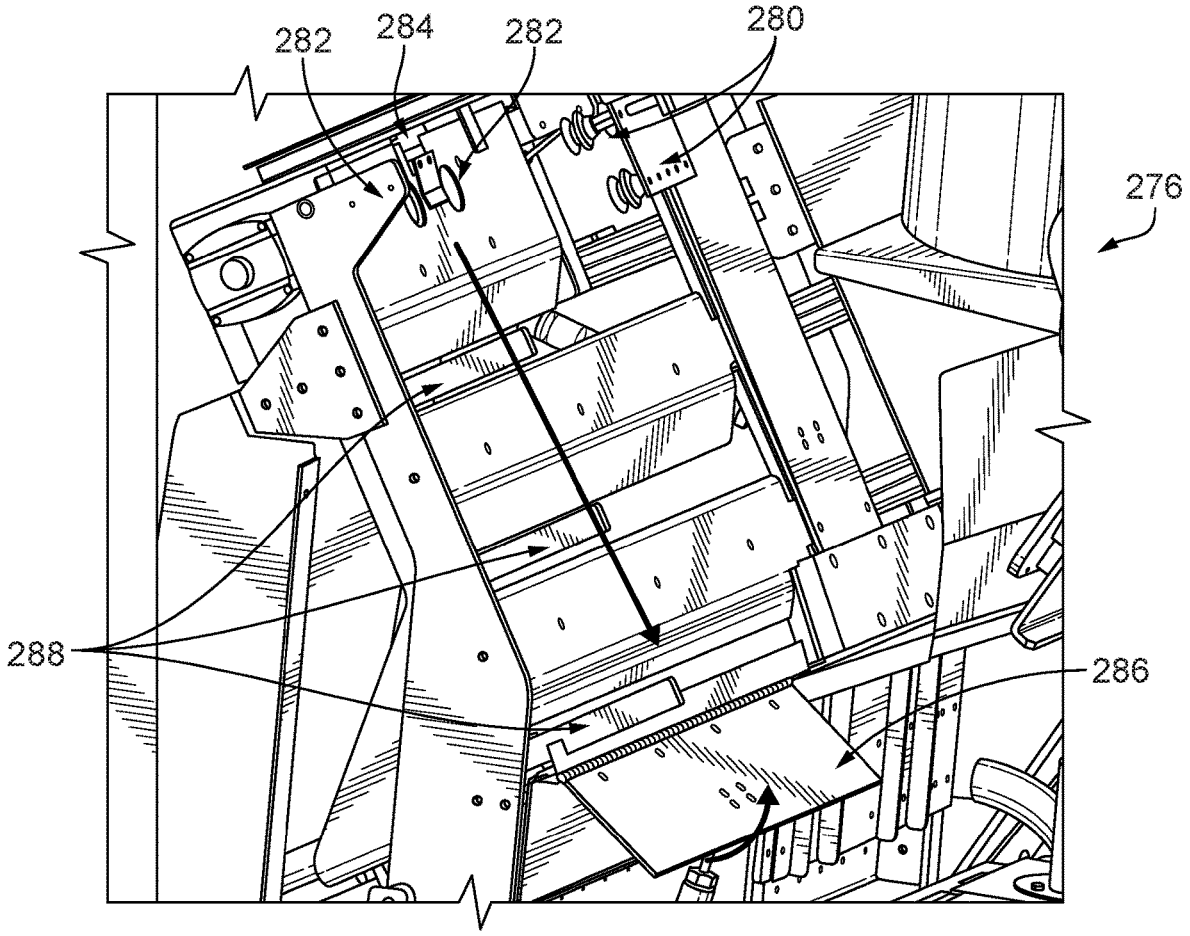
FIG. 30 is a schematic perspective view of the operator loading station of FIGS. 25-29, showing the flip pan.

Referring now to FIG. 30, a flip up pan 286 actuates, e.g. pneumatically, and catches the pouch pre-form 124 after it has been loaded and sent back into the machine. There is a main actuator, e.g. pneumatic, that performs the cross transfer of the pouch, i.e. pushes the three fingers 288 from left to right as oriented in FIG. 30 to push a loaded pouch 124 away from the operator loading station 276. Attached to this actuator is a second actuator, e.g. pneumatic, that retracts the three fingers 288 under the operator loading station 276 as a new pouch pre-form is flipped into position as indicated in FIG. 9 above. The flip pan 286 also clears the way by dropping downward (rotating opposite the direction indicated by the curved arrow in FIG. 30) for the next pouch pre-form 126 to be able to flip into position as shown in FIG. 9. There is a magnetic proximity sensor that detects when the main cross transfer actuator, e.g., pushing the fingers 288 to the right as oriented in FIG. 30, is in its final extended position.

Figure 31A:
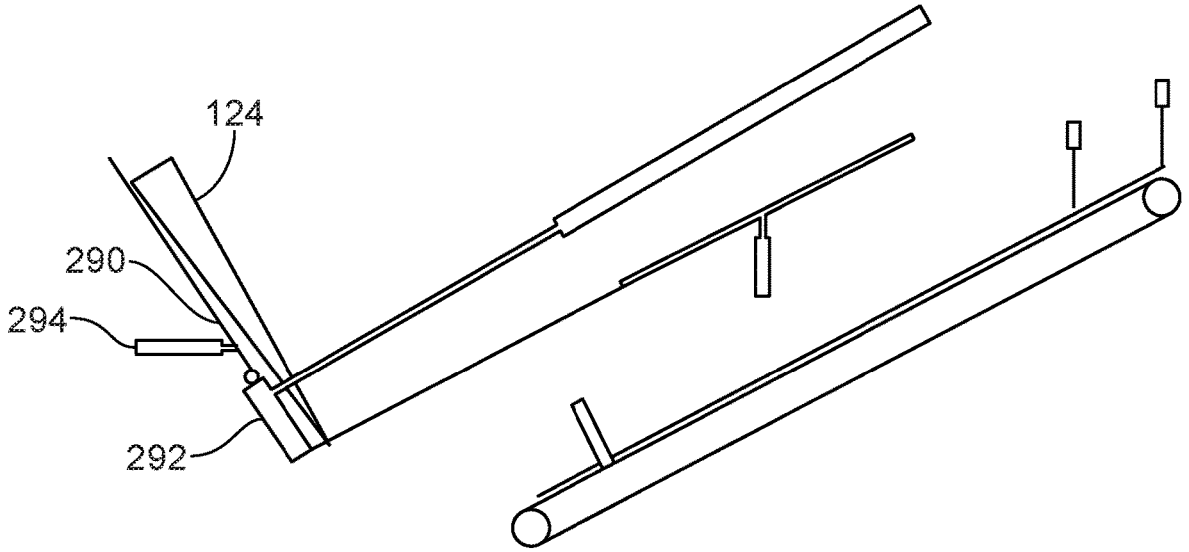
FIGS. 31A-E are schematic side elevation views of a portion of the system of FIGS. 16-19, showing stages of conveying a pouch from the operator loading station to a second gluing stage.
Figure 31B:
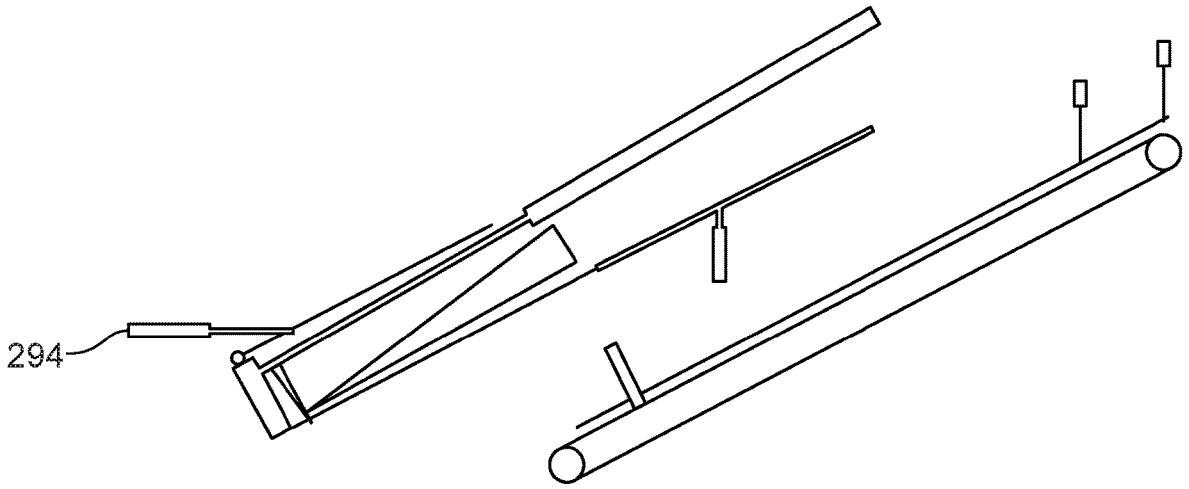
Figure 31C:
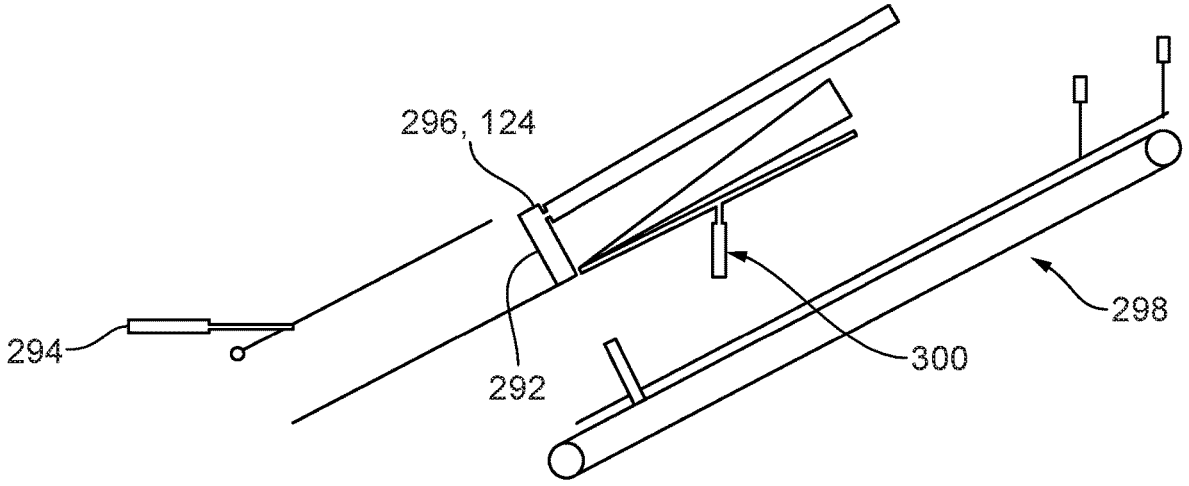
Figure 31D:
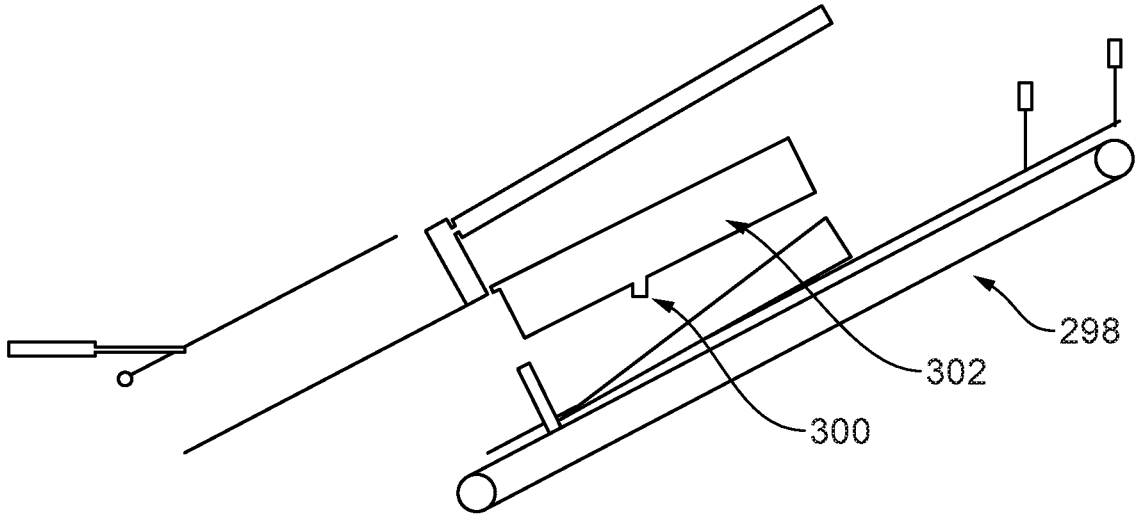

Referring now to FIGS. 31A-31E, a second pivot 290 and lift 292 are provided. After the pouch 124 has been cross transferred by the three fingers 288, the pivot 290 pivots the pouch 124 forward via an actuator 294, e.g. pneumatic, from the position shown in FIG. 31A to the position shown in FIG. 31B. The lift actuator 296, e.g. pneumatic, actuates the lift 292 to lift the pouch 124 to the position shown in FIG. 31C. This positions the pouch 124 to drop onto the final ramp 298 for the second and final glue. As indicated in FIG. 31D, a drop point actuator 300 drops the pouch 124 onto the final ramp 298 via a pair of drop pans 302 (only one of which is visible in FIG. 31D because it occludes the other drop pan 302 as viewed in FIG. 31D) that are actuated, e.g. pneumatically, by the drop point actuator 300.

Figure 31E:
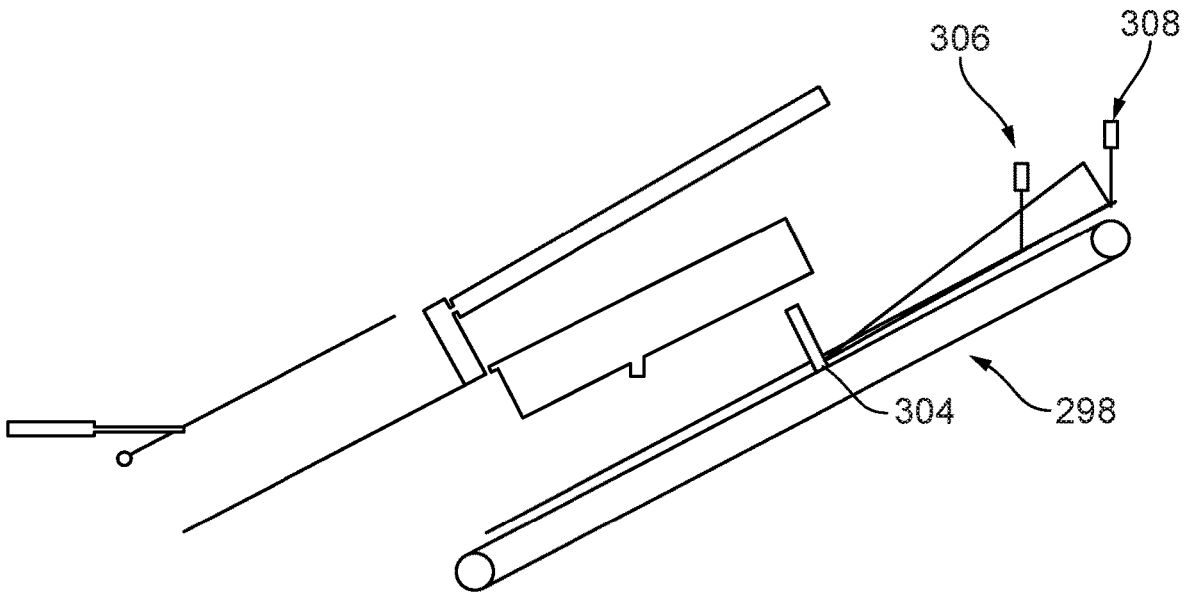

With reference now to FIG. 31E, the pouch 124 drops onto the ramp 298 and is positioned via a motor actuator 304. This motor actuator 304 is a belt driven stepper motor that allows position to be monitored. There are two photo sensors 306, 308 along the ramp 298. The first photo sensor 306 is positioned to detect the leading edge of the pouch 124 to detect if the pouch 124 is in the correct position while transferring to the second gluing position. The second photo sensor 308 is positioned to detect the leading edge of the pouch 124 at the final position of the transfer to the second glue station, as shown in FIG. 31E.

Figure 32:
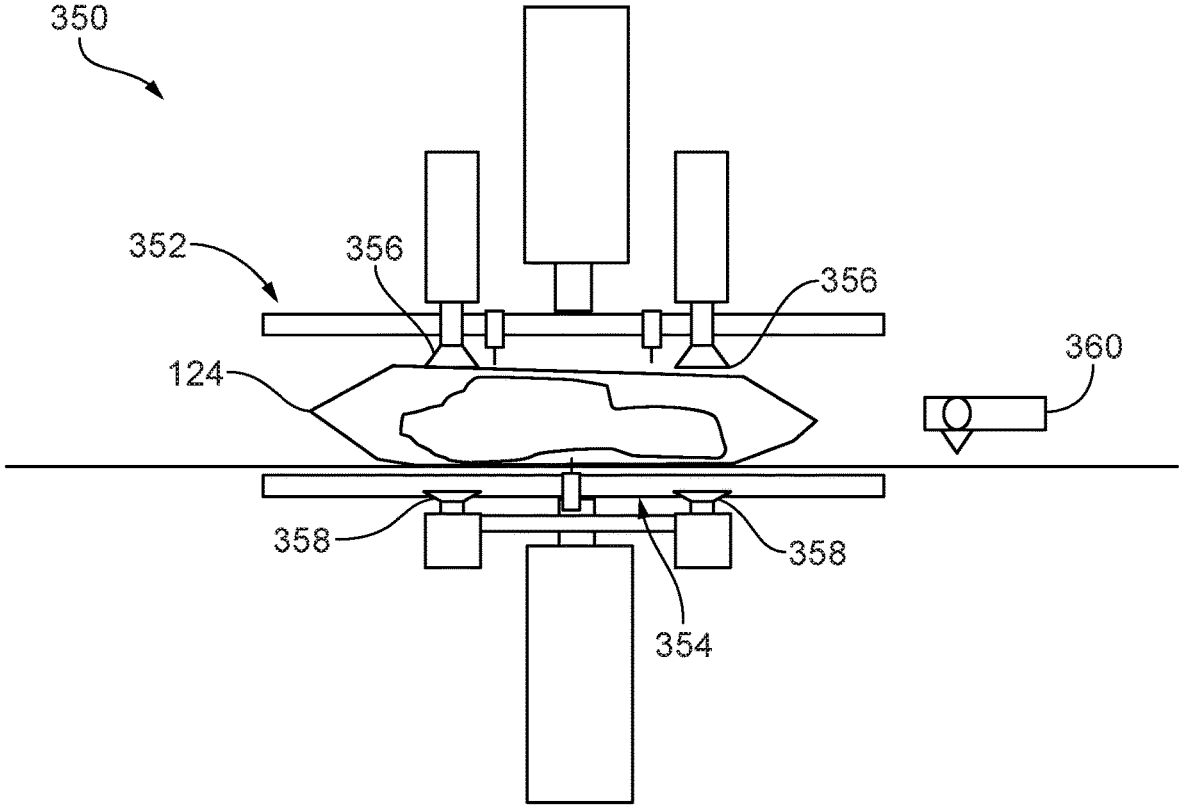
FIGS. 32-36 are schematic end-elevation views of the system of FIG. 16, showing stages of closing the second end of the pouch over contents inside the pouch using another exemplary embodiment of a second closer or gluing station.

With reference now to FIGS. 32-36, another exemplary embodiment of a second closer 350 in the form of a second glue station for closing the final opening of the pouch pre-forms 124 is shown. The second closer 350 can be used in lieu of the second closer 204 shown and described above with reference to FIG. 12. FIG. 32 shows the second closer 350 after a pouch pre-form 124 arrives, but before operation of the second closer 350. The second closer 350 has two pressure bars 352, 354 with respective actuators. The first pressure bar 352 actuates downward from above the pouch pre-form 124. The second pressure bar 354 actuates upward from below the pouch pre-form 124. This helps ensure that pouches 124 with bulky items properly seal. Top and bottom vacuum cups 356, 358 secure and open the pouch 124 to allow for insertion of the glue head 360. The bottom vacuum cups 358 are mechanically coupled with the bottom pressure bar 354. This allows for the pouch 124 to be held secure and not move when the pressure bars 352, 354 actuate to seal the pouch 124.

Figure 33:
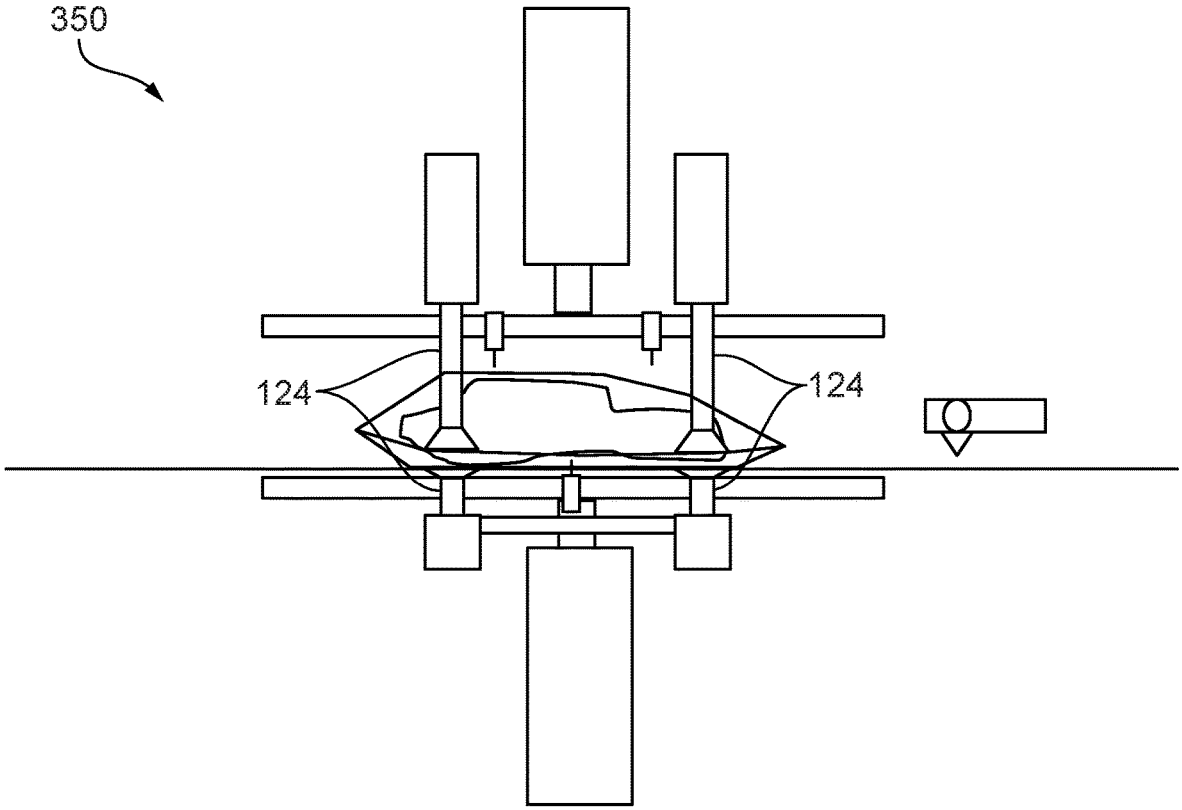
Figure 34:
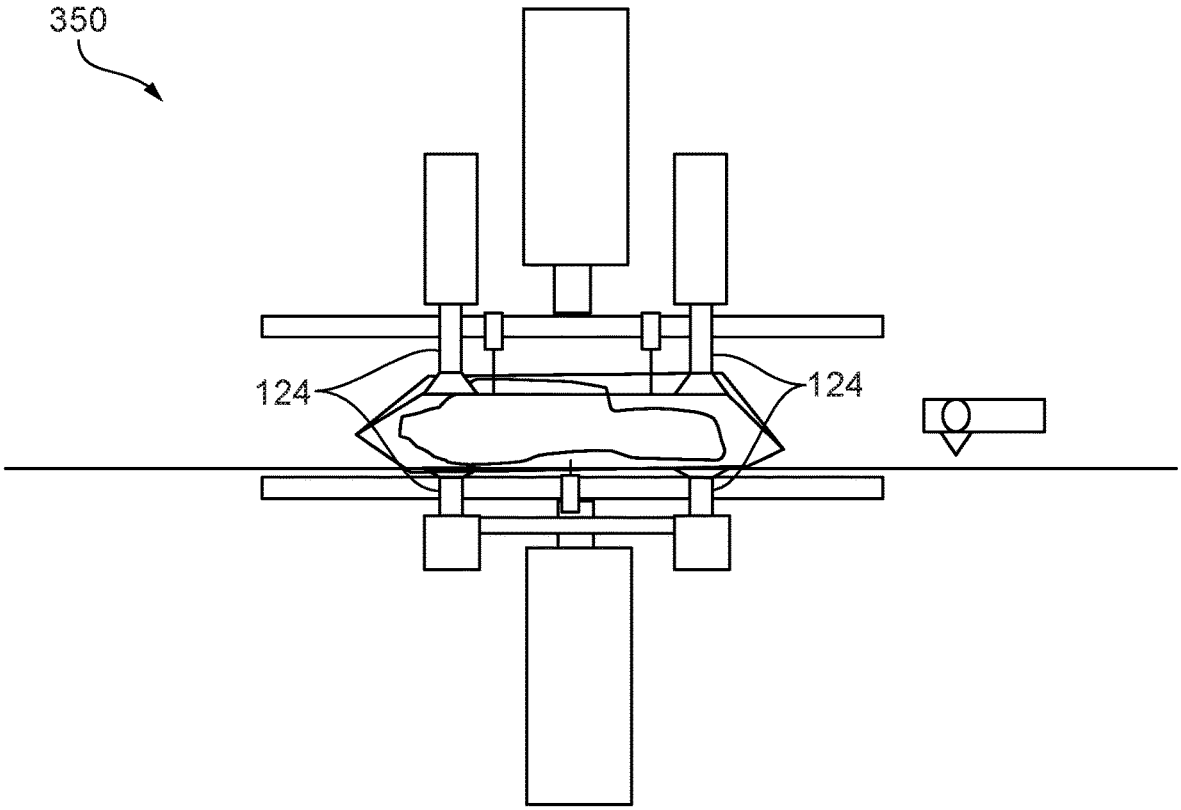
Figure 35:
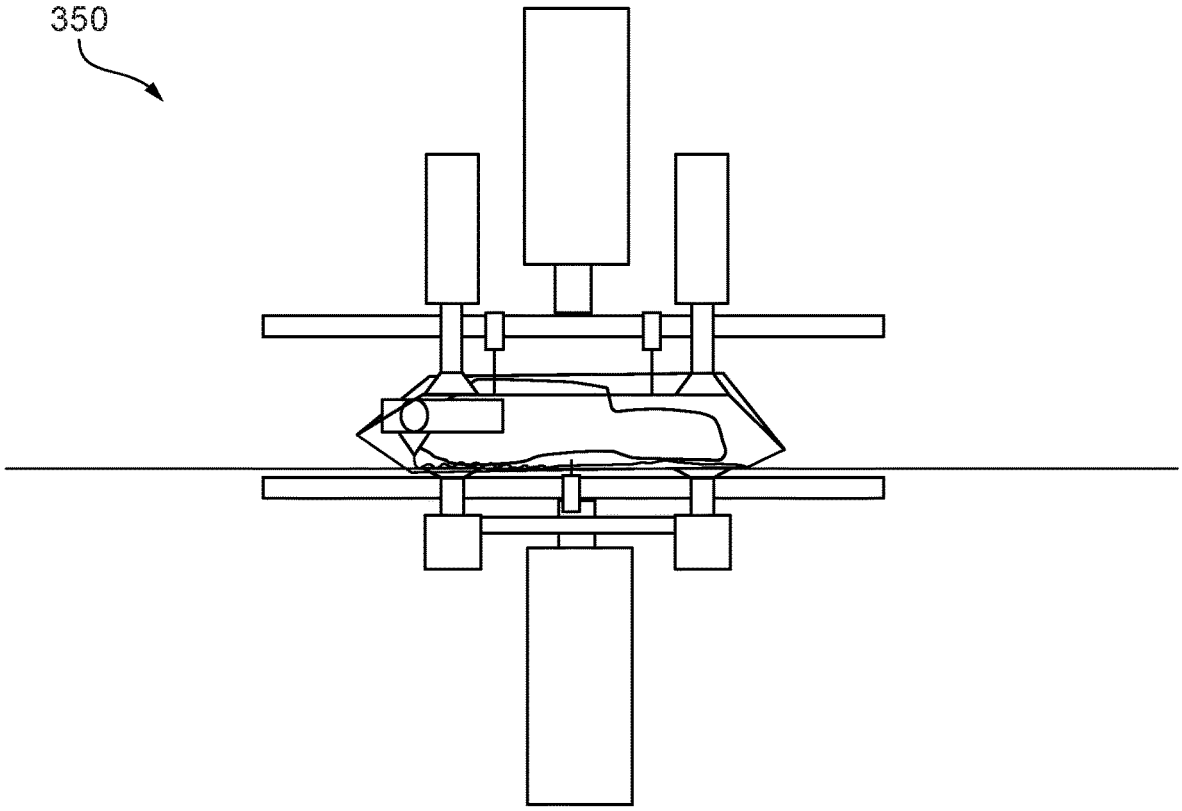

As shown in FIG. 33, the upper vacuum cups 356 lower down and capture the upper edge of the opening of pouch pre-form 124, and lift the upper edge upward to open the pouch pre-form 124 as shown in FIG. 34. With the pouch pre-form 124 open, the glue head 360 can insert and deposit adhesive as shown in FIG. 35, and as described above with respect to the first closer 256. After depositing adhesive, the glue head 360 moves out of the opening of the pouch 124, then the upper and lower pressure bars 352, 354 actuate together to press the opening of the pouch 124 closed onto the adhesive to complete the closure of the pouch 124, as shown in FIG. 36.

Figure 36:
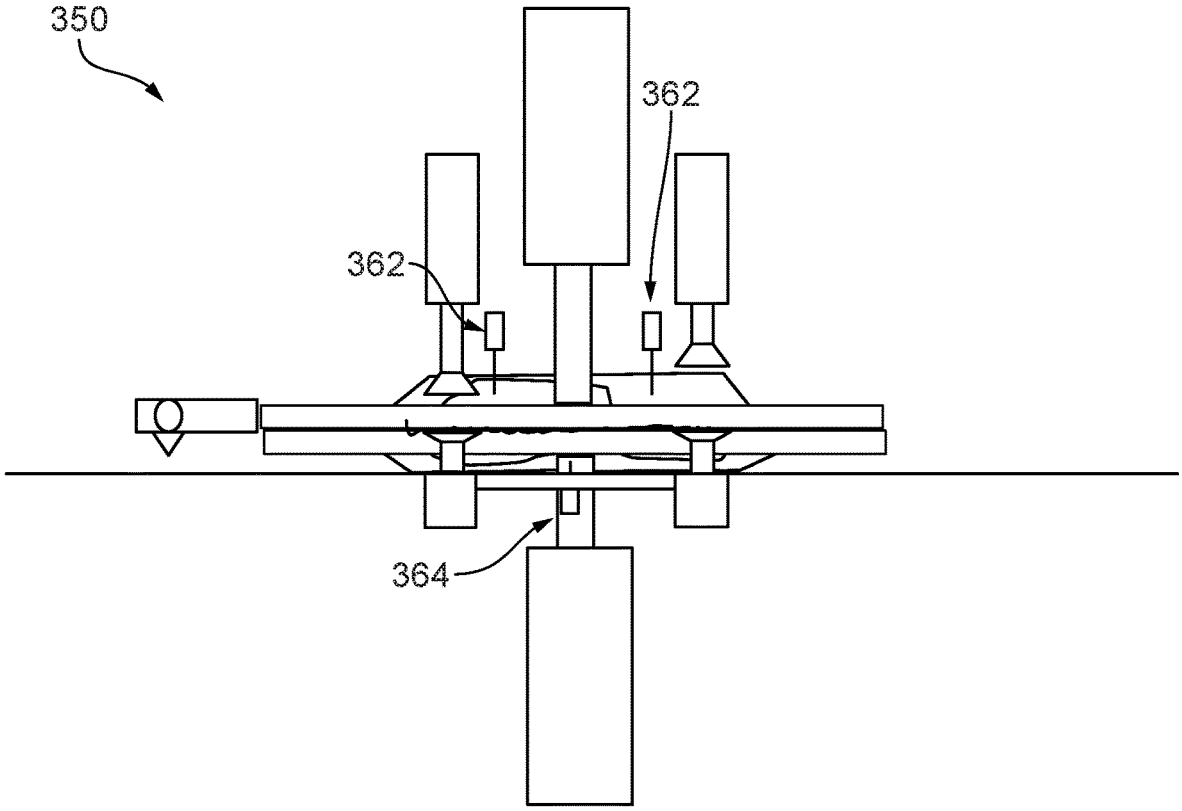
Figure 37:
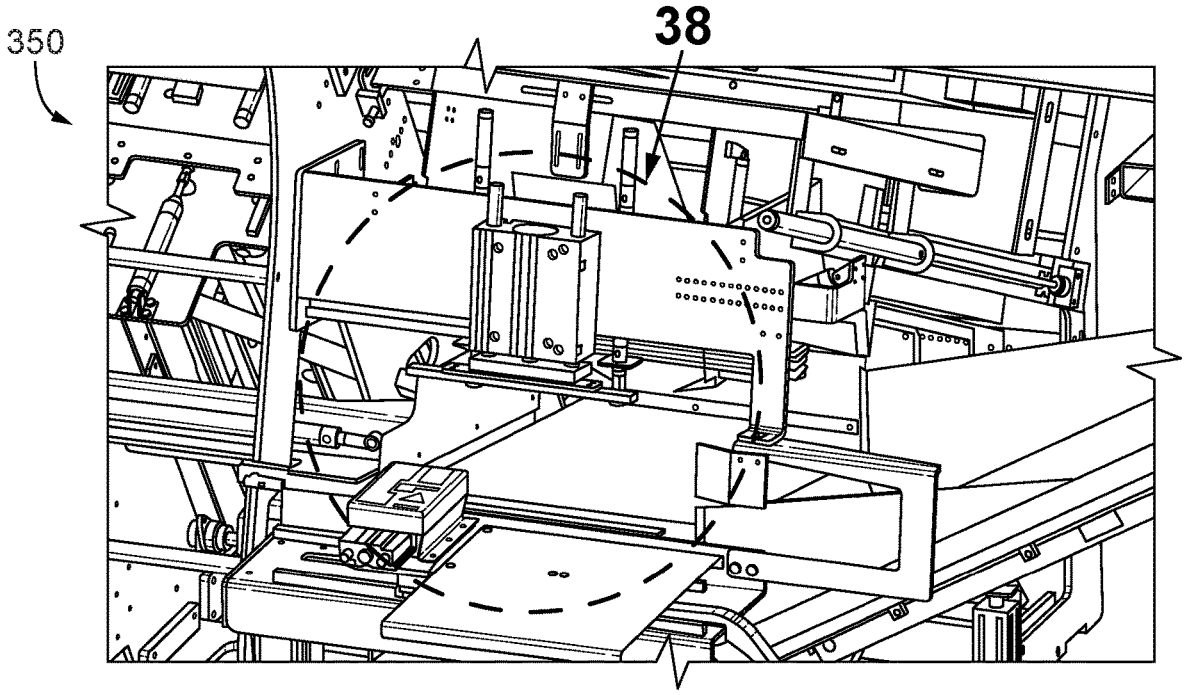
FIGS. 37 and 38 are perspective views of the second gluing station of FIGS. 32-36, showing the suction cups and sensors.
Figure 38:
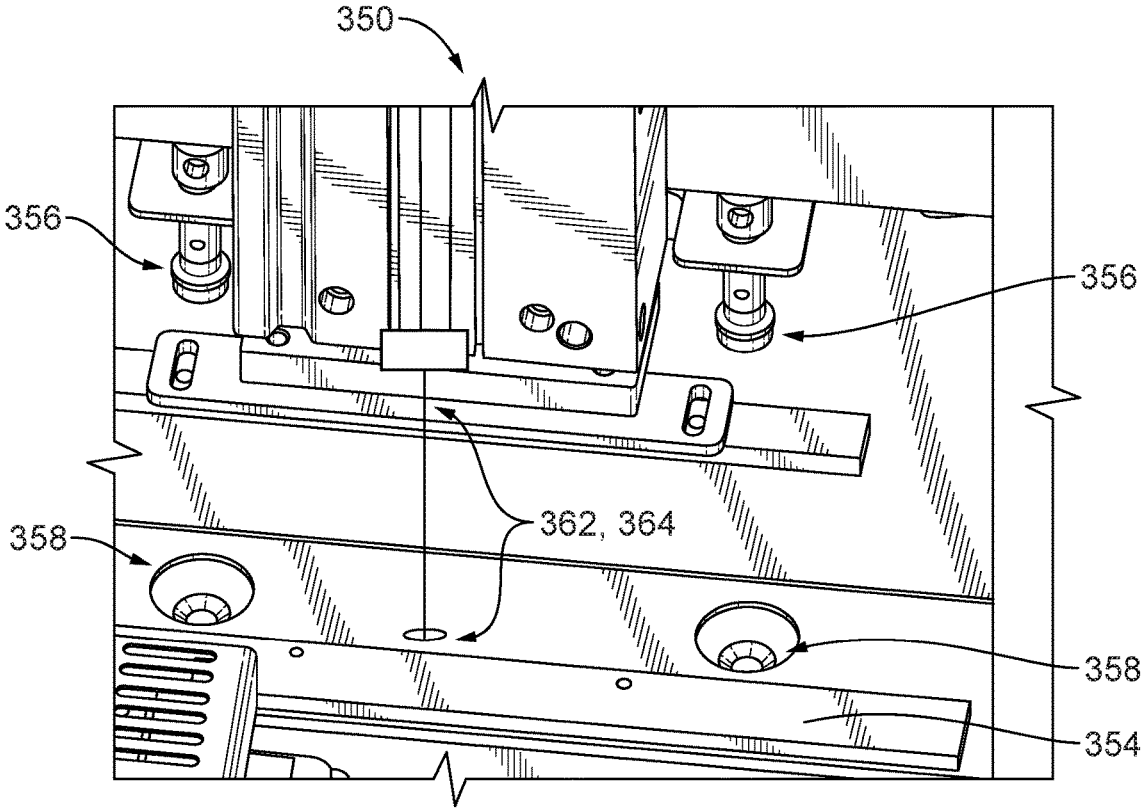

With reference now to FIGS. 37-38, the second closer 350 includes one or more upper photosensors 362 (two are shown in FIG. 36, one is shown in FIG. 38). The upper photosensor(s) 362 detect whether the top layer of the pouch 124 is in position to allow for glue head insertion. A bottom photosensor 364 is also included for detecting whether the bottom layer of the pouch 124 is in position to allow for glue head insertion. After a given pouch 124 is closed at both ends, the pouch 124 can egress from the second closer for labeling and the like, e.g. as described above with respect to FIGS. 14 and 15. The pouch pre-form 124 in FIGS. 16-36 does not have lines of weakness 138 as shown in FIG. 2, as the sides do not need to be pleated for the systems and methods in FIGS. 16-36.

The methods and systems of the present disclosure, as described above and shown in the drawings, provide for shipping packaging for product with superior properties including facilitated custom or bespoke sizing of the packaging for each product coming through a line, e.g. in e-commerce fulfillment. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A system comprising:

a conveyor;

a separator;

a controller operatively connected to the conveyor and to the separator to control the conveyor to drive a custom length of a flattened tube of stock packaging material through the separator, and to control the separator to separate the custom length of the tube from the tube to form a pouch pre-from; and a first closer assembly operatively connected to the separator to receive the pouch pre-form, wherein the first closer assembly includes:

an adhesive applicator mounted for lateral movement relative to a slide that is configured to apply adhesive to one open end of the pouch pre-form;

a pressure plate configured to close the one open end of the pouch pre-form after application of the adhesive; and a set of metal fingers positioned above the pressure plate and the adhesive applicator and in opposition to the slide, wherein the fingers are configured to guide the pouch pre-form into the first closer assembly and assist in forcing the pouch pre-form flat against the slide in case of unwanted upward memory in the pouch pre-form.

2. The system as recited in claim 1, wherein the first closer assembly includes:

a top vacuum cup above the slide that extends through the first closer assembly; and a bottom vacuum cup below the slide, wherein the top and bottom vacuum cups are configured to secure and open the pouch pre-form from opposite sides of the pouch pre-form.

3. The system as recited in claim 1, further comprising a plurality of photosensors positioned to detect whether a top layer of the pouch pre-form is in position to allow for insertion of the adhesive applicator into one end of the open pre-form.

4. The system as recited in claim 3, wherein the plurality of photosensors includes:

a first photosensor positioned to detect that the pouch pre-form has dropped from the conveyor and separator;

a second photosensor positioned to detect whether a bottom layer of the pouch pre-form is in position to allow for insertion of the adhesive applicator; and third and fourth photosensors positioned to detect whether the top layer of the pouch pre-form is in position to allow for insertion of the adhesive applicator.

5. The system as recited in claim 1, wherein the pouch-preform is a custom-sized pre-form to fit the product.

6. The system as recited in claim 1, further comprising:

a filling station operatively connected to the first closer assembly to receive the pouch pre-form with the one open end closed from the first closer assembly.

7. The system as recited in claim 6, wherein the filling station includes opposed top and bottom vacuum cups configured to secure and pull open the pouch pre-form for filling by a user.

8. The system as recited in claim 6, further comprising:

a second closer assembly operatively connected to the filling station to receive pouch pre-forms with product therein from the filling station.

9. The system as recited in claim 8, further comprising a first photo sensor that is positioned to detect a leading edge of the pouch pre-form to detect if the pouch pre-form is in correct position while transferring to the second closer assembly.

10. The system as recited in claim 9, further comprising a second photo sensor positioned to detect the leading edge of the pouch pre-form at a final position of transfer to the second closer assembly.

11. The system as recited in claim 8, wherein the second closer assembly includes a second glue station for closing a final opening of the pouch pre-form.

12. The system as recited in claim 11, wherein the second closer assembly includes a top and bottom pressure bar with respective actuators, wherein the top pressure bar actuates downward from above the pouch pre-form, and wherein the bottom pressure bar actuates upward from below the pouch pre-form to help ensure that pouches seal.

13. The system as recited in claim 12, wherein the second closer assembly includes opposed top and bottom vacuum cups that secure and open the pouch pre-form to allow for insertion of a second adhesive applicator.

14. The system as recited in claim 13, wherein the bottom vacuum cup is mechanically coupled with the bottom pressure bar to allow for the pouch pre-from to be held secure and not move when the pressure bars actuate to seal the pouch pre-form as a pouch.

15. The system as recited in claim 14, wherein the second closer assembly includes an upper photosensor and a bottom photosensor, wherein the upper photosensor is positioned to detect whether a top layer of the pouch pre-form is in position to allow for insertion of the second adhesive applicator and the bottom photosensor is positioned to detect whether a bottom layer of the pouch pre-form is in position to allow for insertion of the second adhesive applicator.

16. The system of claim 1, further comprising:

a sensor for measuring size of a product;

wherein the controller is operatively connected to the sensor to receive the size of the product;

wherein the custom length of the tube is based on the size of the product.

* * * * *